US009685023B2

(12) United States Patent
Ikeya

(10) Patent No.: US 9,685,023 B2
(45) Date of Patent: Jun. 20, 2017

(54) CASH PROCESSING DEVICE

(71) Applicant: Oki Electric Industry Co., Ltd., Tokyo (JP)

(72) Inventor: Ken Ikeya, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/893,933

(22) PCT Filed: Apr. 11, 2014

(86) PCT No.: PCT/JP2014/060549

§ 371 (c)(1),
(2) Date: Nov. 24, 2015

(87) PCT Pub. No.: WO2014/192443

PCT Pub. Date: Dec. 4, 2014

(65) Prior Publication Data

US 2016/0110941 A1 Apr. 21, 2016

(30) Foreign Application Priority Data

May 29, 2013 (JP) ..... 2013-113279

(51) Int. Cl.
*G07F 7/04* (2006.01)
*G07D 11/00* (2006.01)

(52) U.S. Cl.
CPC ..... *G07D 11/0084* (2013.01); *G07D 11/0021* (2013.01); *G07D 11/0051* (2013.01); *G07F 7/04* (2013.01)

(58) Field of Classification Search
CPC ..... G07D 11/0021; G07D 11/0033; G07D 11/0051; G07D 11/0066; G07D 11/0084; G07D 2211/00; G07F 7/04
See application file for complete search history.

(56) References Cited

U.S. PATENT DOCUMENTS 6,015,147 A 1/2000 Kimura et al.
6,352,254 B1 3/2002 Kimura et al.
6,357,598 B1 3/2002 Kimura et al.
(Continued)

FOREIGN PATENT DOCUMENTS

CN 102542667 A 7/2012
JP 2004-295909 A 10/2004
(Continued)

*Primary Examiner* — Mark Beauchaine
(74) *Attorney, Agent, or Firm* — Rabin & Berdo, P.C.

(57) ABSTRACT

Provided is a cash processing device including a pay-in section, a pay-out section, a medium identification section, one or plural medium storage sections that each includes a stacking function and a separating function, a temporary holding section that includes a stacking function and a separating function, and a pay-in processing section that, based on a classification result by the medium identification section for a medium taken in through the pay-in section, conveys a medium to be stored in the one or plural medium storage sections to the corresponding one or plural medium storage sections, and that conveys a medium not to be stored in the one or plural medium storage sections to the temporary holding section.

7 Claims, 14 Drawing Sheets

(56) References Cited

U.S. PATENT DOCUMENTS

| | | | | |
|---|---|---|---|---|
| 2004/0084521 | A1* | 5/2004 | Nagayoshi | G07D 11/0051 235/379 |
| 2010/0185317 | A1* | 7/2010 | Aso | G07D 11/0018 700/214 |
| 2012/0012436 | A1 | 1/2012 | Nakamoto et al. | |
| 2012/0173013 | A1* | 7/2012 | Nakamoto | G07D 11/0084 700/215 |
| 2013/0046407 | A1 | 2/2013 | Tomizawa et al. | |
| 2014/0144750 | A1* | 5/2014 | Shimizu | G07D 11/0072 194/206 |

FOREIGN PATENT DOCUMENTS

| | | | |
|---|---|---|---|
| JP | 2010-224738 | A | 10/2010 |
| JP | 2012-108820 | A | 6/2012 |
| JP | 2013-041425 | A | 2/2013 |
| WO | WO-2011/030438 | A1 | 3/2011 |

* cited by examiner

FIG.10A

| | | | No stack in temporary holding section or serial number of second non-confirmed banknote has been detected | | Stack present in temporary holding section and serial number of second non-confirmed banknote not yet detected | Awaiting confirmed banknote (Separate two additional notes) | Awaiting halt in conveyance |
|---|---|---|---|---|---|---|---|
| | | | Quantity of notes instructed to be returned − quantity of notes returned ≥ 2 | Quantity of notes instructed to be returned − quantity of notes returned = 1 | | | |
| | | | 1−1 | 1−2 | 2 | 3 | 4 |
| Banknotes of verifiable quantity: quantity = 1 | Serial number = second non-confirmed banknote | A | • increment quantity of notes returned by 1<br>• convey to pay-out port | • convey to temporary holding section<br>• return of the originals not possible (counting error)<br>• → 4 (await halt in conveyance) | • set quantity of notes instructed to be returned−1 to quantity of notes returned<br>• convey to pay-out port<br>• → 1 | • convey to temporary holding section<br>• return of the originals not possible (counting error)<br>• → 4 (await halt in conveyance) | • Convey to temporary holding section |
| | Serial number = first non-confirmed banknote | B | • increment quantity of notes returned by 1<br>• convey to pay-out port<br>• return of the originals not possible (counting error)<br>• → 4 (await halt in conveyance) | [return of the originals confirmed]<br>• increment quantity of notes returned by 1<br>• convey to pay-out port (following note to temporary holding section)<br>• → 4 (await halt in conveyance) | [return of the originals confirmed]<br>• increment quantity of notes returned by 1<br>• convey to pay-out port (following note to temporary holding section)<br>• → 4 (await halt in conveyance) | • convey to temporary holding section<br>• return of the originals not possible (counting error)<br>• → 4 (await halt in conveyance) | |
| | Serial number = first confirmed banknote | C | • convey to temporary holding section<br>• return of the originals not possible (counting error)<br>• → 4 (await halt in conveyance) | • convey to temporary holding section<br>• return of the originals not possible (counting error)<br>• → 4 (await halt in conveyance) | [return of the originals confirmed]<br>• convey to pay-out port (following note to temporary holding section)<br>• → 4 (await halt in conveyance) | [return of the originals confirmed]<br>• convey to temporary holding section (following note to temporary holding section)<br>• → 4 (await halt in conveyance) | |
| | Serial number = second confirmed banknote | D | • convey to temporary holding section<br>• return of the originals not possible (counting error)<br>• → 4 (await halt in conveyance) | • convey to temporary holding section<br>• return of the originals not possible (counting error)<br>• → 4 (await halt in conveyance) | • Convey to temporary holding section<br>• return of the originals not possible (original cannot be guaranteed)<br>• → 4 (await halt in conveyance) | • Convey to temporary holding section including banknote following behind<br>Convey banknote immediately prior to temporary holding section as banknote of which the quantity can be verified (1)<br>[return of the originals confirmed]<br>• → 4 (await halt in conveyance)<br>Other<br>Return of the originals not possible (original cannot be guaranteed)<br>• → 4 (await halt in conveyance) | |
| | Other | E | • increment quantity of notes returned by 1<br>• convey to pay-out port | [return of the originals confirmed]<br>• increment quantity of notes returned by 1<br>• convey to pay-out port (following note to temporary holding section)<br>• → 4 (await halt in conveyance) | • increment quantity of notes returned by 1<br>• convey to pay-out port | • Convey to temporary holding section | |

FIG.10B

| | | No stack in temporary holding section or serial number of second non-confirmed banknote has been detected | | Stack Present in temporary holding section and serial number of second non-confirmed banknote not yet detected | Awaiting confirmed banknote (Separate two additional notes) | Awaiting halt in conveyance |
|---|---|---|---|---|---|---|
| | | Quantity of notes instructed to be returned − quantity of notes returned ≥ 2 | Quantity of notes instructed to be returned − quantity of notes returned = 1 | | | |
| | | 1-1 | 1-2 | 2 | 3 | 4 |
| Banknotes of verifiable quantity: quantity = 2 | F | [return of the originals confirmed]<br>• increment quantity of notes returned by 2<br>• convey to pay-out port (following note to temporary holding section)<br>• → 4 (await halt in conveyance) | • convey to temporary holding section<br>• return of the originals not possible (original cannot be guaranteed)<br>• → 4 (await halt in conveyance) | • increment quantity of notes returned by 2<br>Quantity of notes returned ≤ quantity of notes instructed to be returned<br>• convey to pay-out ports<br>Quantity of notes returned > quantity of notes instructed to be returned<br>• convey to temporary holding section | • convey to temporary holding section | • convey to temporary holding section |
| Banknotes of unverifiable quantity: quantity = 1 or more | G | • increment quantity of notes returned by 1<br>• convey to temporary holding section<br>• → 2 | • increment quantity of notes returned by 1<br>• convey to temporary holding section<br>• → 3 | • increment quantity of notes returned by 1<br>• convey to temporary holding section | • convey to temporary holding section | |
| Banknotes of unverifiable quantity: quantity = 2 or more | H | • increment quantity of notes returned by 2<br>• convey to temporary holding section<br>• → 3 | • convey to temporary holding section<br>• return of the originals not possible (original cannot be guaranteed)<br>• → 4 (await halt in conveyance) | • increment quantity of notes returned by 2<br>• convey to temporary holding section | • convey to temporary holding section | |
| Common processing Processing executed regardless of nature of verified quantity after above processing | I | | | Quantity of notes returned = quantity of notes instructed to be returned<br>• → 3<br>Quantity of notes returned > quantity of notesinstructed to be returned<br>• return of the originals not possible (original cannot be guaranteed)<br>• → 4 (await halt in conveyance) | Separation halted and no medium present on conveyance path<br>• return of the originals not possible (original cannot be guaranteed)<br>• halt conveyance | Separation halted and no medium present on conveyance path<br>• halt conveyance<br>When [return of the originals confirmed]<br>• to return processing for temporary holding section |

CASH PROCESSING DEVICE

TECHNICAL FIELD

The present invention relates to a cash processing device, and may for example be applied to a cash processing device that performs cash pay-in processing.

BACKGROUND ART

Cash processing devices that manage paying in and paying out of currency are installed in, for example, branches of financial institutions such as banks or consumer financial institutions (for example at a service counter in a branch) (see Japanese Patent Application Laid-Open (JP-A) No. 2010-224738). Cash processing devices perform pay-in processing and pay-out processing of currency in the branch or the like, and, for example, perform retrieval processing to retrieve currency stored in banknote cassettes inside the cash processing device.

As cash processing devices, conventional recirculating cash processing devices exist that pay out banknotes that have been paid in. FIG. 1 is an internal mechanism diagram illustrating internal mechanisms of a recirculating cash processing device 10. As illustrated in FIG. 1, the cash processing device 10 includes a pay-in port 1, one or plural pay-out ports 2 (2-1, 2-2) (two in FIG. 1), a temporary holding section 3, a banknote identification section 4, a conveyance section 5, plural banknote cassettes 6-1 to 6-5 (five in FIG. 1), and a storage-only cassette 7.

The banknote cassettes 6-1 to 6-5 include a banknote stacking function and a banknote separating function, and the storage-only cassette 7 includes only a banknote stacking function.

Stacking refers to sequential storage of paid in banknotes in the cassette. Separating refers to feeding out the uppermost banknote of a group of banknotes stored inside the cassette during pay out.

In a pay-in transaction using a conventional cash processing device, banknotes are inserted into the pay-in port 1 by an operator, and the inserted banknotes are fed out to the conveyance section 5 one note at a time. The fed out banknotes are conveyed to the banknote identification section 4, and the banknote identification section 4 classifies the banknotes. Banknotes determined to be normal are conveyed to the temporary holding section 3 by the conveyance section 5, and the banknotes are accumulated in the temporary holding section 3. On the other hand, banknotes determined to be rejects are conveyed to the pay-out ports 2 by the conveyance section 5 and returned. Note that banknotes returned to the pay-out ports 2 can be reclassified by reinsertion into the pay-in port 1.

After pay-in has been completed, when storing the banknotes in the banknote cassettes 6-1 to 6-5, the banknotes accumulated in the temporary holding section 3 are fed out one note at a time by the conveyance section 5. The fed out banknotes are conveyed to the banknote identification section 4, and the banknote identification section 4 classifies the banknotes. Banknotes determined to be normal are accumulated in the banknote cassettes 6-1 to 6-5 that store the corresponding denomination based on the denomination of the banknote identified by the banknote identification section 4. Banknotes determined to be rejects are accumulated in the storage-only cassette as reject banknotes.

Processing relating to pay-in transactions includes the normal pay-in processing described above, and direct pay-in processing. Normal pay-in processing is processing in which the banknotes paid in as described above are temporarily held in the temporary holding section 3, before the banknotes are accumulated in the corresponding banknote cassettes 6-1 to 6-5 after pay-in has been completed. On the other hand, direct pay-in processing is processing in which the paid in banknotes are directly paid into the corresponding banknote cassettes 6-1 to 6-5, without being held back in the temporary holding section 3.

Namely, in direct pay-in processing, banknotes fed out from the pay-in port 1 are conveyed to the banknote identification section 4, and the banknote identification section 4 classifies the banknotes. Based on the denomination of the banknotes identified by the banknote identification section 4, banknotes determined to be normal are then stored in the banknote cassettes 6-1 to 6-5 that store the corresponding denomination.

However, when the banknote is of a non-pay-out denomination, the banknote is accumulated in the storage-only cassette. Note that banknotes determined to be rejects are returned to the pay-out ports 2.

SUMMARY OF INVENTION

Technical Problem

However, in the conventional recirculating cash processing device described above, since the storage-only cassette does not include a separating function, when return of banknotes paid in in direct pay-in processing is requested, any banknotes stored in the storage-only cassette cannot be returned, and so the actual notes that a customer has paid in cannot be returned.

There is accordingly demand for cash processing devices capable of returning a paid in medium in cases in which an inserted medium is directly paid into a medium storage section.

Solution to Problem

One aspect of the present invention provides a cash processing device including: (1) a pay-in section that takes in an inserted medium; (2) a pay-out section that dispenses a medium; (3) a medium identification section that classifies a conveyed medium; (4) one or plural medium storage sections that each includes a stacking function to store a medium that has been conveyed in, and a separating function to separate and feed out an accumulated medium; (5) a temporary holding section that includes a stacking function to temporarily store a medium that has been conveyed in, and a separating function to separate and feed out a stored medium; and (6) a pay-in processing section that, based on a classification result by the medium identification section for a medium taken in through the pay-in section, conveys a medium to be stored in the one or plural medium storage sections to the corresponding one or plural medium storage sections, and that conveys a medium not to be stored in the one or plural medium storage sections to the temporary holding section.

Advantageous Effects of Invention

The present invention is capable of returning a paid in medium in cases in which an inserted medium is directly paid into a medium storage section.

BRIEF DESCRIPTION OF DRAWINGS

FIG. 10A is an explanatory drawing (1) to explain return conditions in return processing for directly paid in banknotes according to the second exemplary embodiment.

FIG. 10B is an explanatory drawing (2) to explain return conditions in return processing for directly paid in banknotes according to the second exemplary embodiment.

DESCRIPTION OF EMBODIMENTS

(A) First Exemplary Embodiment

Detailed explanation follows regarding a first exemplary embodiment of a cash processing device of the present invention, with reference to the drawings.

The first exemplary embodiment describes an example of a case in which the present invention is applied to a cash processing device that is capable of direct pay-in processing and includes recirculating banknote cassettes, and a non-recirculating storage-only cassette.

(A-1) Configuration of First Exemplary Embodiment

Figure 1:
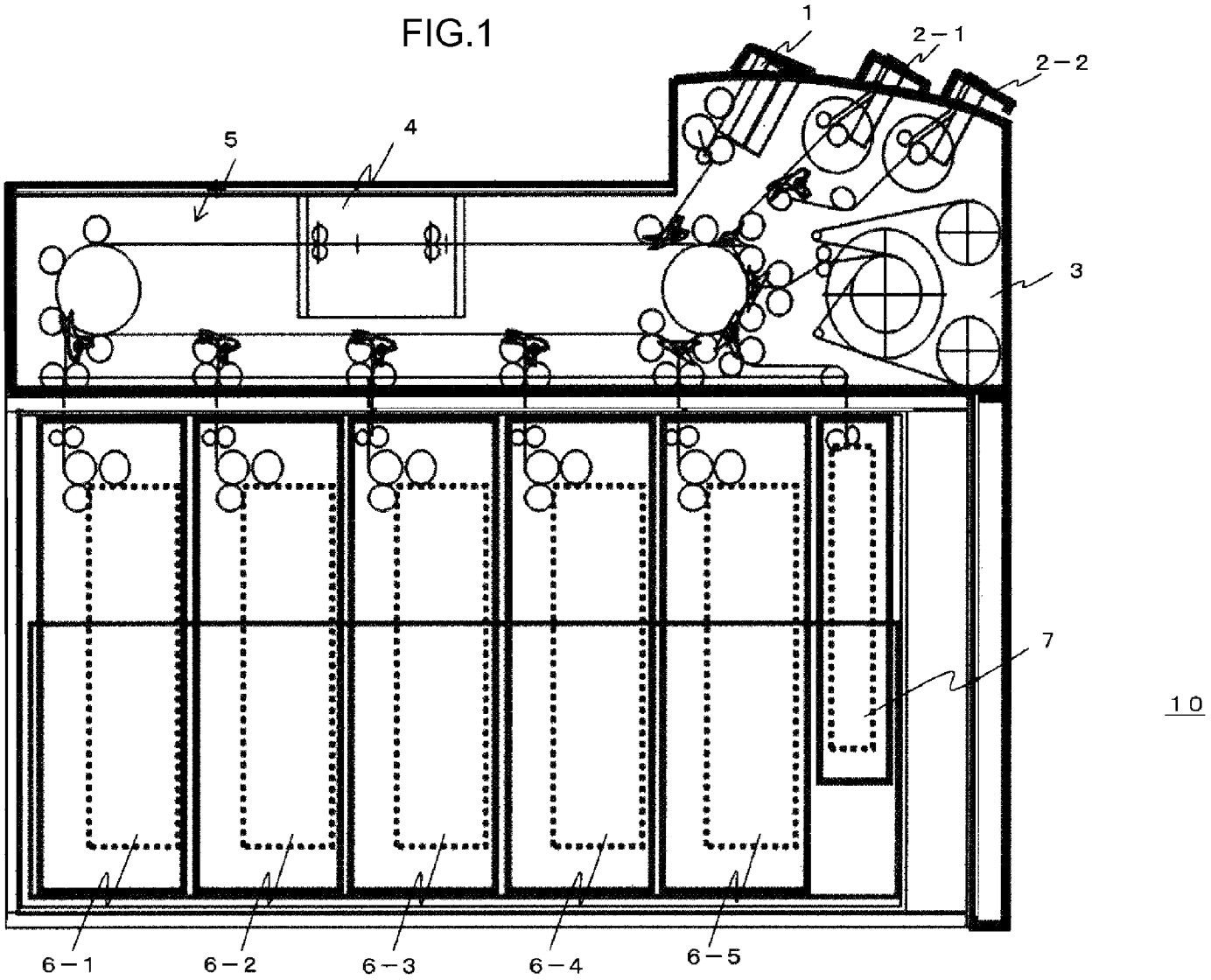
FIG. 1 is an internal configuration diagram illustrating internal mechanisms of a cash processing device according to a first exemplary embodiment.

Internal mechanisms of a cash processing device according to the first exemplary embodiment are the same as, or correspond to, the cash processing device illustrated in FIG. 1. Accordingly, in the first exemplary embodiment, the internal mechanisms of the cash processing device are described with reference to FIG. 1.

FIG. 1 is an internal configuration diagram illustrating internal mechanisms of a cash processing device 10 according to the first exemplary embodiment. FIG. 1 is a drawing viewed from the side of the cash processing device 10, in which the inside of a case can be seen through.

In FIG. 1, the cash processing device 10 according to the first exemplary embodiment includes a pay-in port 1, one or plural pay-out ports 2 (2-1, 2-2) (two in FIG. 1), a temporary holding section 3, a banknote identification section 4, a conveyance section 5, plural banknote cassettes 6-1 to 6-5 (five in FIG. 1), and a storage-only cassette 7.

The pay-in port 1 takes in banknotes that are being paid in. The pay-in port 1 has a separating function to feed out banknotes one note at a time after they have, for example, been placed therein by an operator. Namely, the pay-in port 1 feeds out banknotes one note at a time for conveyance to the banknote identification section 4 by the conveyance section 5. Many overlapping banknotes may be placed in the pay-in port 1. As an example, the many banknotes are placed in the pay-in port 1 at an angle; however, there is no limitation thereto. For example, the pay-in port 1 may be an upright type in which many banknotes are placed standing upright, or may be a horizontal type in which many banknotes are placed horizontally.

The pay-out ports 2 (2-1, 2-2) dispense banknotes. The pay-out ports 2 include a stacking function to stack banknotes. Namely, the pay-out ports 2 stack dispensed banknotes in the sequence that they are dispensed, and can store many stacked banknotes.

The banknote identification section 4 classifies banknotes conveyed by the conveyance section 5. The banknote identification section 4 identifies the state of passing banknotes, determines the authenticity (determines genuine notes or counterfeit notes), determines the physical condition (determines soiled notes, torn notes, damaged notes, misshapen notes, folded notes, and good condition notes), and also determines the denomination of banknotes, performs count processing, and the like.

The banknote identification section 4 makes normal determination and reject determination. Reject determination includes, for example, determining notes to be counterfeit notes, soiled notes, torn notes, damaged notes, misshapen notes, folded notes, and the like. The banknote identification section 4 can accommodate banknotes traveling in either direction, and is capable of classifying banknotes traveling either toward the left or toward the right in FIG. 1.

The temporary holding section 3 temporarily accumulates banknotes out of banknotes that have been paid in that have been determined to be normal. The temporary holding section 3 also temporarily accumulates banknotes out of banknotes paid in by direct pay-in processing that have denominations (non-pay-out denominations) other than the denominations (pay-out denominations) allocated to the banknote cassettes 6-1 to 6-5, described later.

The temporary holding section 3 also temporarily accumulates some banknotes out of banknotes to be returned when the return of paid in banknotes is requested after direct pay-in processing. Further, the temporary holding section 3 also temporarily accumulates rejected banknotes out of banknotes for pay-out.

The temporary holding section 3 includes a banknote stacking function and a banknote separating function. The temporary holding section 3 stacks banknotes conveyed there by the conveyance section 5, and feeds out stored banknotes to the conveyance section 5 one note at a time.

The banknote cassettes 6-1 to 6-5 are recirculating banknote storage sections that each include a banknote stacking function and a banknote separating function. Namely, the banknote cassettes 6-1 to 6-5 stack banknotes conveyed there by the conveyance section 5, and feed out stored banknotes to the conveyance section 5 one note at a time. Further, the denominations stored by the respective banknote cassettes 6-1 to 6-5 are decided in advance. Furthermore, the banknote cassettes 6-1 to 6-5 are detachable with respect to the cash processing device 10. This thereby enables banknote replenishment and banknote retrieval.

The storage-only cassette 7 is a non-recirculating banknote storage section that only includes a banknote stacking function. The storage-only cassette 7 is a multipurpose banknote cassette capable of storing banknotes that have been placed in various categories. For example, the storage-only cassette 7 may store reject banknotes, or may store normal banknotes, foreign banknotes, counterfeit notes, or the like.

The conveyance section 5 conveys banknotes between the respective units described above (namely, the pay-in port 1, the pay-out ports 2, the temporary holding section 3, the banknote identification section 4, the respective banknote cassettes 6-1 to 6-5, and the storage-only cassette 7).

Figure 2:
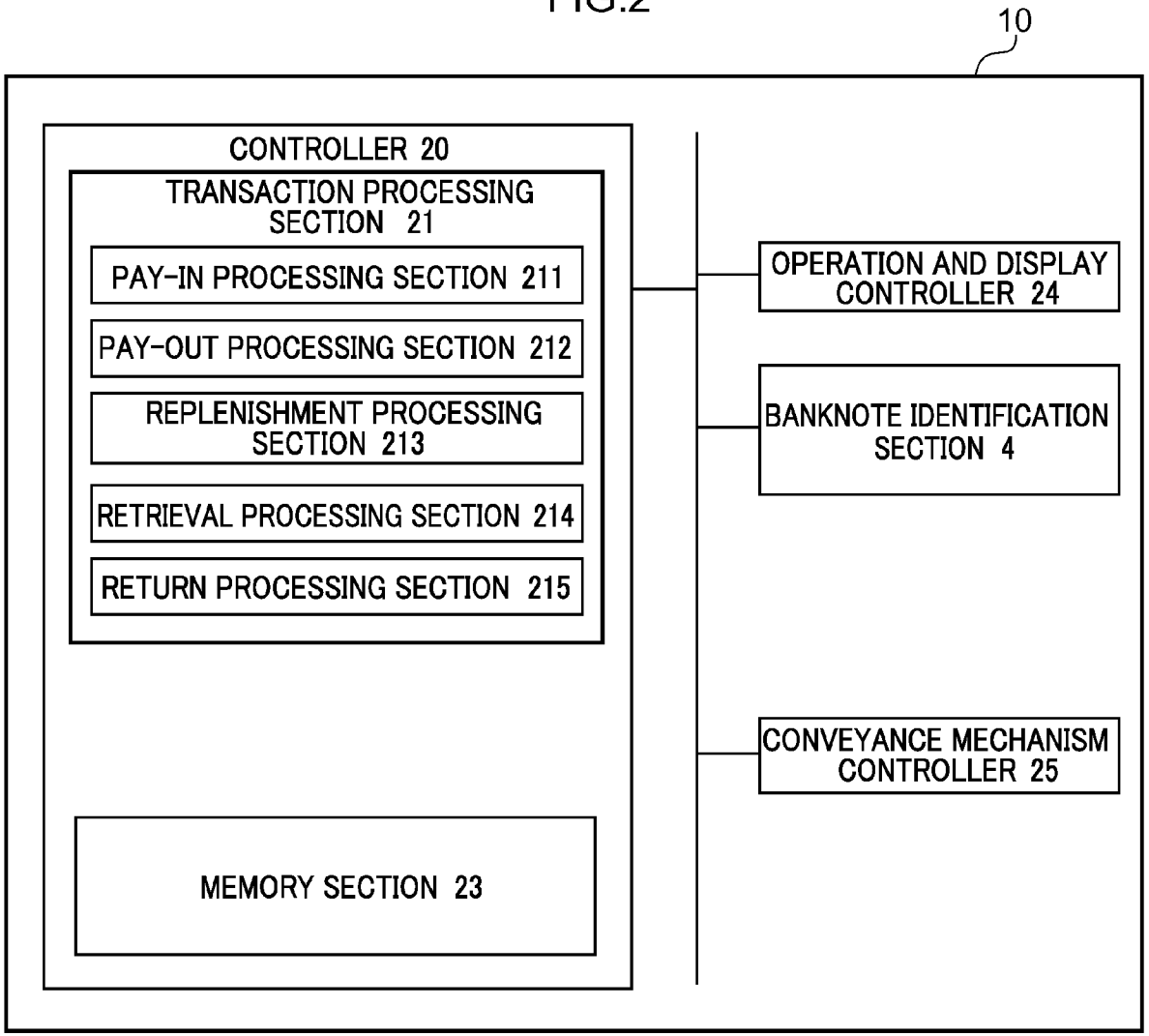
FIG. 2 is a block diagram illustrating configuration of a control system of a cash processing device of the first exemplary embodiment.

FIG. 2 is a block diagram illustrating configuration of a control system of the cash processing device 10 of the first exemplary embodiment.

As a control system, the cash processing device 10 illustrated in FIG. 2 includes a controller 20, an operation and display controller 24, the banknote identification section 4, and a conveyance mechanism controller 25.

The controller 20 is, for example, a computer including a processor and memory (for example, a microcomputer or the like). The processor executes a processing program to implement the various functions of the cash processing device 10. Further, the processing program may be implemented by installation. In such cases, the functionality of the processing program may still be illustrated as in FIG. 2.

A transaction processing section 21 is included as a processing section executed by the controller 20, as illustrated in FIG. 2.

The transaction processing section 21 controls various transactions in the cash processing device 10. As illustrated in FIG. 2, the transaction processing section 21 includes a pay-in processing section 211, a pay-out processing section 212, a replenishment processing section 213, a retrieval processing section 214, and a return processing section 215.

The pay-in processing section 211 performs pay-in processing for banknotes inserted through the pay-in port 1. The pay-in processing performed by the pay-in processing section 211 includes normal pay-in processing and direct pay-in processing.

Normal pay-in processing is processing in which banknotes are temporarily held back in the temporary holding section 3 after being classified by the banknote identification section 4, and, after completion of pay-in, the banknotes are passed to the banknote identification section 4 again, and paid into the corresponding banknote cassettes 6-1 to 6-5 based on the classification results.

Direct pay-in processing is processing in which the inserted banknotes are passed to the banknote identification section 4, and are then paid directly into the corresponding banknote cassettes 6-1 to 6-5 based on the classification results of the banknote identification section 4, without being held back in the temporary holding section 3.

The pay-out processing section 212 performs pay-out processing on banknotes accumulated in the corresponding banknote cassettes 6-1 to 6-5 based on pay-out information (for example the denominations and number of notes per denomination to be paid out) input using an operation and display section, not illustrated in the drawings. The pay-out processing section 212 passes banknotes that have been fed out from the banknote cassettes 6-1 to 6-5 to the banknote identification section 4, and pays out the banknotes into the pay-out ports 2 following classification of the banknotes by the banknote identification section 4.

The replenishment processing section 213 performs processing to replenish the banknotes accumulated in the banknote cassettes 6-1 to 6-5. Note that the replenishment processing section 213 includes pay-in port replenishment (insertion port replenishment), cassette counted replenishment, and cassette exchange replenishment.

Pay-in port replenishment (insertion port replenishment) is processing to replenish the banknote cassettes 6-1 to 6-5 with banknotes inserted into the pay-in port 1 through the conveyance section 5. In the processing of pay-in port replenishment (insertion port replenishment), the banknotes are classified and counted by the banknote identification section 4, and are used to replenish the corresponding banknote cassettes 6-1 to 6-5 directly, without being held back in the temporary holding section 3, similarly to in direct pay-in processing.

In cassette counted replenishment, any banknote cassette out of the banknote cassettes 6-1 to 6-5 (for example, the banknote cassette 6-5) is loaded with banknotes for replenishment. Processing is then performed such that banknotes fed out from the replenishment banknote cassette 6-5 are classified and counted by the banknote identification section 4, and are used to replenish the banknote cassettes 6-1 to 6-4 of the corresponding denomination.

Cassette exchange replenishment is a method in which a fresh banknote cassette that has been loaded with banknotes in advance is exchanged with an existing banknote cassette and set in the cash processing device 10. In cassette exchange replenishment, the banknote identification section 4 does not perform count processing. An operator accordingly follows a predetermined exchange procedure to record the denomination and the quantity of notes thereof in the cash processing device 10.

The retrieval processing section 214 performs processing to retrieve banknotes accumulated in the banknote cassettes 6-1 to 6-5 of the cash processing device 10. The retrieval processing section 214 performs pay-out port retrieval, cassette counted retrieval, and cassette exchange retrieval.

Pay-out port retrieval is processing to dispense and retrieve banknotes accumulated in the banknote cassettes 6-1 to 6-5 from the pay-out ports 2, using the conveyance section 5. In pay-out port retrieval processing, similarly to in pay-out processing, banknotes fed out from the banknote cassettes 6-1 to 6-5 are passed to the banknote identification section 4, and the banknotes are paid out from the pay-out ports 2 after the banknotes have been classified by the banknote identification section 4.

In cassette counted retrieval, any banknote cassette out of the banknote cassettes 6-1 to 6-5 (for example, the banknote cassette 6-5) is set in advance for use in retrieval. Processing is then performed such that banknotes fed out from the banknote cassettes 6-1 to 6-4 are classified and counted by the banknote identification section 4, and are retrieved to the retrieval banknote cassette 6-5.

Cassette exchange retrieval is a method in which the banknotes accumulated in the banknote cassettes 6-1 to 6-5 and the storage-only cassette 7 of the cash processing device 10 are taken out and the denomination and quantity thereof are counted by following a predetermined retrieval procedure.

A memory section 23 is stored with a processing program that is executed by the controller 20, data required during processing, and the like.

The operation and display controller 24 controls the operation and display section (not illustrated in the drawings) with which the operator performs predetermined operations, and that displays processing results of the cash processing device 10. The operation and display controller 24 passes information input by the operator (for example transaction type selection information, information relating to the denomination and quantity of notes for paying in or out, and paid in banknote return instruction information) to the controller 20. The operation and display controller 24 also displays pay-in and pay-out information from the controller 20 (for example the denomination and quantity of notes counted during pay-in and pay-out) on the operation and display section.

The banknote identification section 4 classifies passing banknotes as described above, and passes the classification results to the controller 20.

The conveyance mechanism controller 25 controls drive to actuate the conveyance section 5 under control of the controller 20.

(A-2) Operation of First Exemplary Embodiment

Next, detailed explanation follows regarding processing of the cash processing device 10 of the first exemplary embodiment, with reference to the drawings.

(A-2-1) Banknote Conveyance Control Processing for Each Transaction Type

First, explanation follows regarding banknote conveyance control by the controller 20 during normal pay-in processing, pay-out processing, replenishment processing, and retrieval processing, with reference to FIG. 1.

The pay-in processing section 211 of the controller 20 performs normal pay-in processing when the operator selects a normal pay-in transaction.

First, as illustrated in FIG. 1, the operator inserts banknotes into the pay-in port 1. The inserted banknotes are fed out to the conveyance section 5 one note at a time. The fed out banknotes are conveyed to the banknote identification section 4, and the banknote identification section 4 classifies the banknotes. Banknotes determined to be normal by the banknote identification section 4 are conveyed to the temporary holding section 3 by the conveyance section 5, and are accumulated in the temporary holding section 3. On the other hand, banknotes determined to be rejects by the banknote identification section 4 are conveyed to the pay-out ports 2 by the conveyance section 5 and returned. Note that notes returned to the pay-out ports 2 can be classified again by reinsertion into the pay-in port 1.

After pay-in has been completed, in cases in which the banknotes are to be stored in the banknote cassettes 6-1 to 6-5, the banknotes accumulated in the temporary holding section 3 are fed out one note at a time by the conveyance section 5. The fed out banknotes are conveyed to the banknote identification section 4, and the banknote identification section 4 classifies the banknotes. Banknotes determined to be normal are accumulated in the banknote cassettes 6-1 to 6-5 storing the relevant denomination based on the denomination identified by the banknote identification section 4. Banknotes determined to be rejects are accumulated in the storage-only cassette as reject banknotes.

Next, explanation follows regarding banknote conveyance control in a pay-out transaction. The pay-out processing section 212 of the controller 20 performs pay-out processing when the operator selects a pay-out transaction.

In FIG. 1, banknotes are fed out from the banknote cassettes 6-1 to 6-5 one note at a time according to the instructed denominations and quantity of notes. The fed out banknotes are classified by the banknote identification section 4. Banknotes determined to be normal by the banknote identification section 4 are stacked in the pay-out ports 2. Banknotes determined to be rejects by the banknote identification section 4 are accumulated in the storage-only cassette 7 as reject banknotes.

Next, explanation follows regarding banknote conveyance control during replenishment processing. Note that as described above, pay-in port replenishment (insertion port replenishment) is processing that is the same as or corresponds to normal pay-in processing, and cassette exchange replenishment is performed according to a predetermined exchange procedure by the operator, and so detailed explanation of these is omitted herein. Accordingly, explanation follows regarding banknote conveyance control during cassette counted replenishment.

Suppose that out of the banknote cassettes 6-1 to 6-5, the banknote cassette 6-5 is the replenishment banknote cassette. The banknote cassette 6-5 is pre-loaded with the replenishment banknotes. The banknotes with which the banknote cassette 6-5 is loaded are not limited to a single denomination, and the banknote cassette 6-5 may be loaded with plural denominations.

During cassette counted replenishment, banknotes that have been fed out one note at a time from the replenishment banknote cassette 6-5 are passed to the banknote identification section 4 by the conveyance section 5. The fed out banknotes are classified by the banknote identification section 4. Banknotes determined to be normal by the banknote identification section 4 are accumulated in the corresponding banknote cassettes 6-1 to 6-4. Banknotes determined to be rejects by the banknote identification section 4 are accumulated in the storage-only cassette 7 as reject banknotes.

Next, explanation follows regarding banknote conveyance control during retrieval processing. As described above, pay-out retrieval is processing that is the same as, or corresponds to, pay-out processing, and cassette exchange retrieval is performed according to a predetermined retrieval procedure by the operator, and so detailed explanation of these is omitted herein. Accordingly, explanation follows regarding banknote conveyance control during cassette counted replenishment.

Suppose that out of the banknote cassettes 6-1 to 6-5, the banknote cassette 6-5 is the retrieval banknote cassette.

Banknotes fed out one note at a time from any one of the banknote cassettes 6-1 to 6-4 set in the cash processing device 10 are passed to the banknote identification section 4 by the conveyance section 5. The fed out banknotes are classified by the banknote identification section 4. Banknotes determined to be normal by the banknote identification section 4 are stacked in the retrieval banknote cassette 6-5. Banknotes determined to be rejects by the banknote identification section 4 are accumulated in the storage-only cassette 7 as reject banknotes. The above processing is performed for each of the banknote cassettes 6-1 to 6-4 in a predetermined sequence.

When all counting relating to retrieval has been completed, the operator only removes the storage-only cassette 7 from the cash processing device 10, thereby completing the task of retrieval. Note that the retrieval banknote cassette 6-5 is removed and retrieved from the cash processing device 10 by a secure logistics specialist.

(A-2-2) Banknote Conveyance Control Processing in Direct Pay-In Processing

Next, explanation follows regarding banknote conveyance control in direct pay-in processing in the cash processing device 10 of the first exemplary embodiment, with reference to the drawings.

Figure 3A:
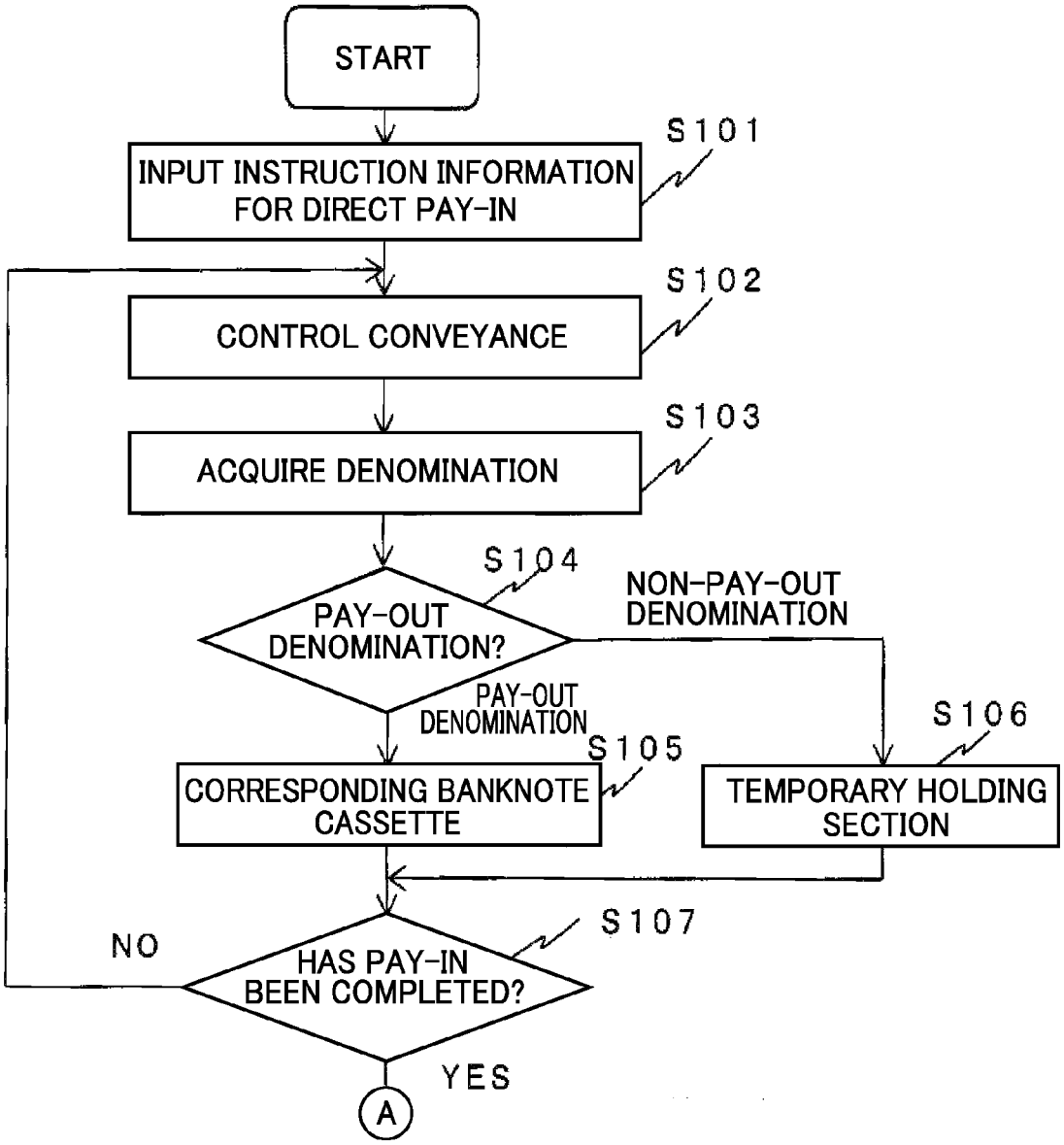
FIG. 3A is a flowchart (1) illustrating banknote conveyance processing and return processing in direct pay-in processing of a cash processing device of the first exemplary embodiment.
Figure 3B:
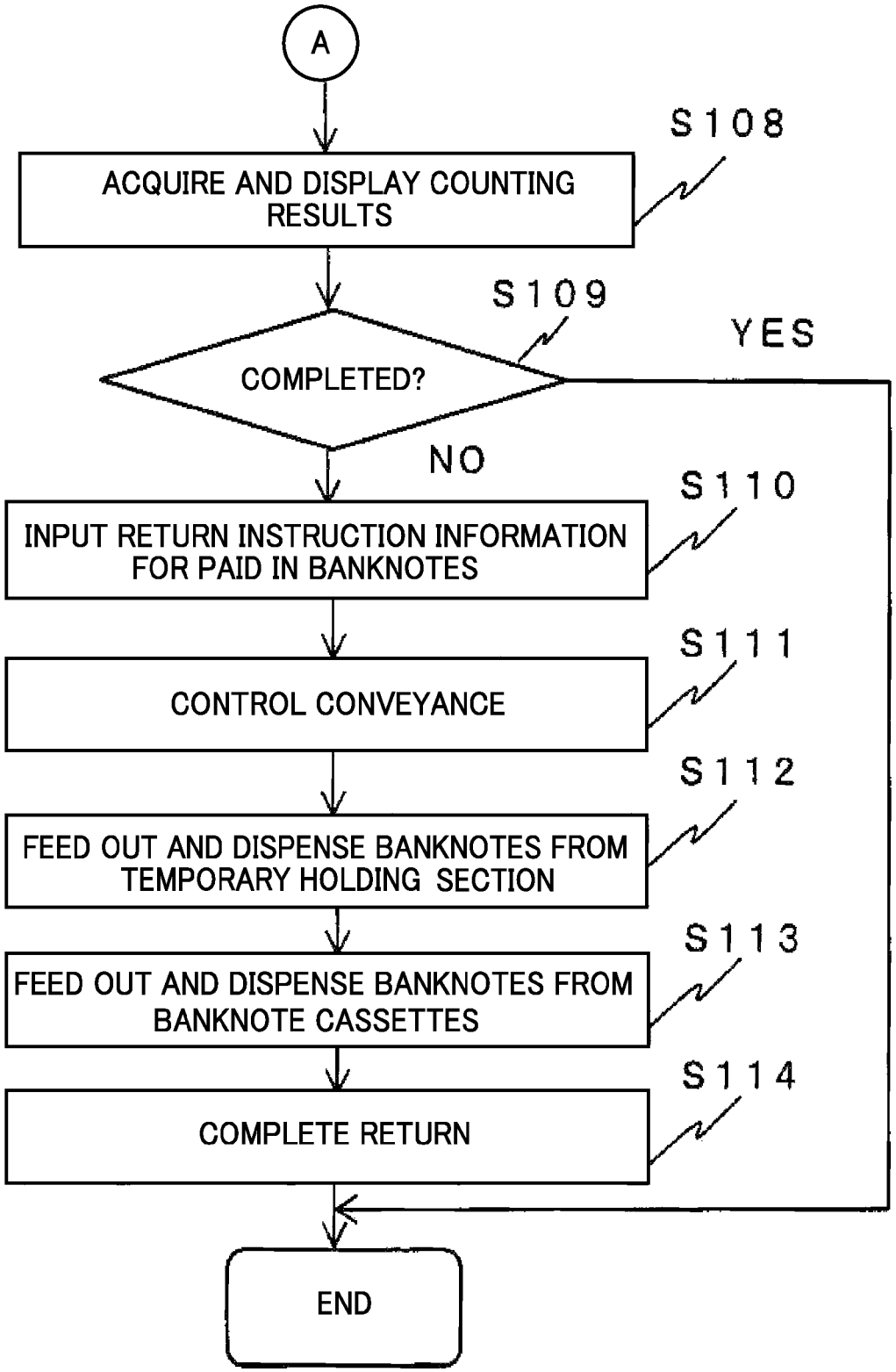
FIG. 3B is a flowchart (2) illustrating banknote conveyance processing and return processing in direct pay-in processing of a cash processing device of the first exemplary embodiment.

FIG. 3A and FIG. 3B are flowcharts illustrating banknote conveyance control processing and return processing in direct pay-in processing in the cash processing device 10 of the first exemplary embodiment.

First, instruction information for direct pay-in is input by operator operation, and is passed to the controller 20 by the operation and display controller 24. When the controller 20 is input with the direct pay-in instruction information (S101), the pay-in processing section 211 performs banknote conveyance control for direct pay-in using the conveyance mechanism controller 25 (S102). The conveyance mechanism controller 25 controls actuation of the conveyance section 5 under control of the controller 20.

First, the banknotes placed in the pay-in port 1 are fed out one note at a time. The fed out banknotes reach the banknote identification section 4 via the conveyance section 5. The banknote identification section 4 performs banknote classification on banknotes that have reached the banknote identification section 4.

Note that the banknote identification section 4 determines the banknote denomination, banknote authenticity, physical condition, quantity, and so on of the passing banknotes. Determination results for the determination of the banknote identification section 4 are passed to the controller 20.

When the determination results of the banknote identification section 4 have been passed to the pay-in processing section 211 of the controller 20 (S103), the pay-in processing section 211 decides the stacking destination of each banknote based on the banknote denomination included in the determination results. Namely, the pay-in processing section 211 determines whether or not the denomination of the banknote is a pay-out denomination that is accumulated in the recirculating banknote cassettes 6-1 to 6-4 (S104). Note that the banknote cassette 6-5 is a replenishment or retrieval banknote cassette, and is therefore not used as a stacking destination.

When the banknote denomination is a pay-out denomination, the pay-in processing section 211 decides on the banknote cassette 6-1 to 6-4 of the corresponding denomination as the stacking destination. The banknote is passed to the banknote cassette 6-1 to 6-4 of the corresponding denomination by the conveyance section 5, and stacked (S105).

In cases in which the banknote denomination is a non-pay-out denomination, the pay-in processing section 211 decides on the temporary holding section 3 as the stacking destination. The banknote is passed to the temporary holding section 3 by the conveyance section 5 and stacked (S106).

The processing of S102 to S106 is repeated until pay-in has been completed for all of the banknotes placed in the pay-in port 1 (S107). When pay-in has been completed for all of the banknotes, the pay-in processing section 211 calculates the counting results relating to pay-in (for example, the denominations and quantity of paid in banknotes, the total value, and the like). The pay-in processing section 211 passes the counting results relating to pay-in to the operation and display controller 24 to be displayed by the operation and display section (S108).

When completion of the pay-in transaction is instructed by operator operation (S109), the banknotes accumulated in the temporary holding section 3 are conveyed to the storage-only cassette 7, and processing is ended.

On the other hand, suppose that completion of the pay-in transaction is not instructed by operator operation (S109), and an instruction is input by the operator to return the paid in banknotes (S110). Namely, when pay-in has been completed for all of the banknotes placed in the pay-in port 1, but the pay-in transaction itself is not completed, a return instruction is input.

Figure 4:
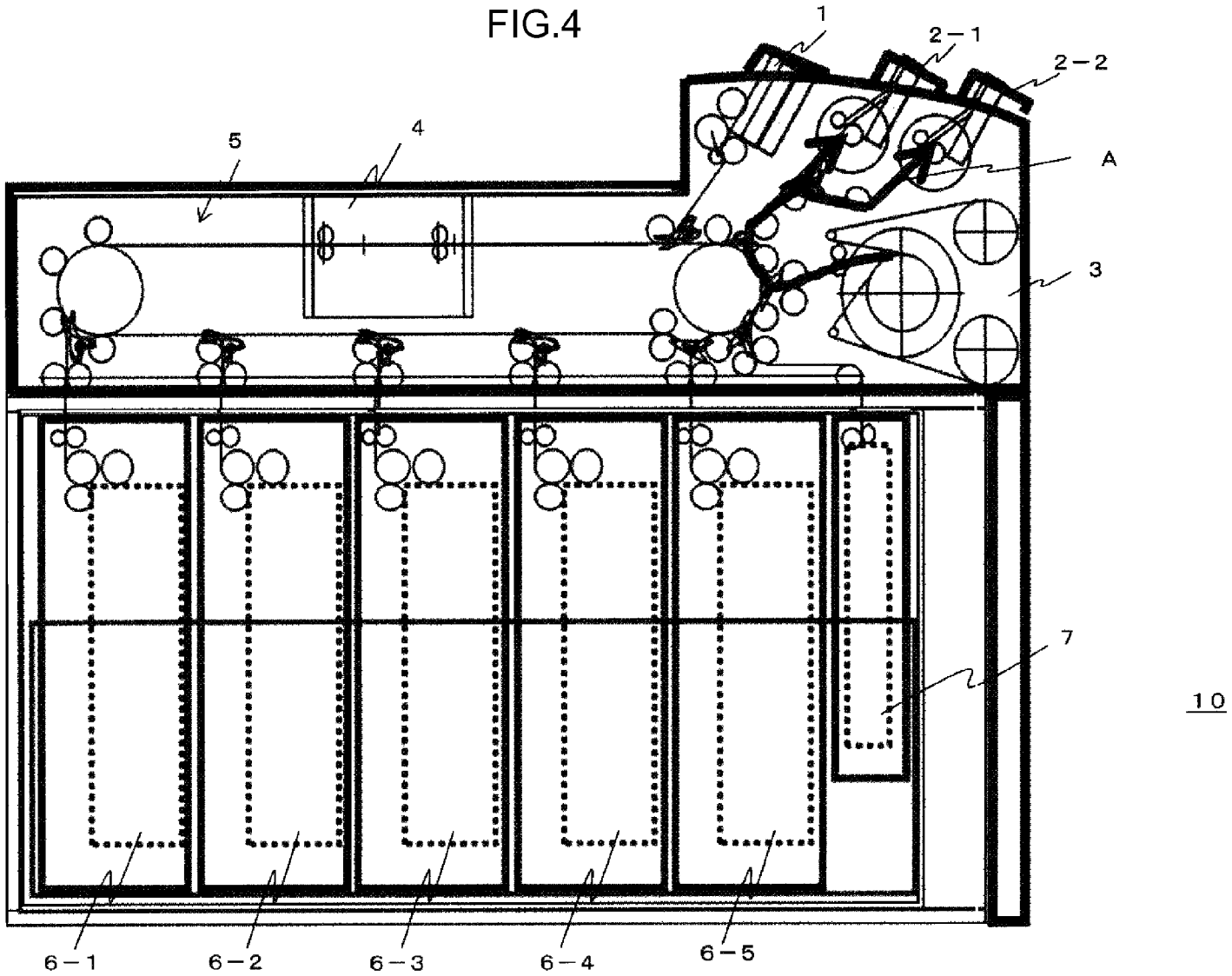
FIG. 4 is an explanatory drawing to explain banknote conveyance when returning banknotes stacked in a temporary holding section of the first exemplary embodiment.

When a return instruction for the paid in banknotes is input by operator operation, the return processing section 215 performs return processing for the paid in banknotes, without completing the pay-in transaction (S111). When this is performed, firstly, the banknotes stacked in the temporary holding section 3 are fed out one note at a time. The banknotes are dispensed into the pay-out ports 2 via the conveyance section 5, as illustrated by the arrow A in FIG. 4 (S112).

Namely, in conventional direct pay-in processing, when the denomination of a banknote is a non-pay-out denomination, the banknote is stacked in the storage-only cassette 7 that does not include a separating function. Paid in banknotes of non-pay-out denominations that have been stacked in the storage-only cassette 7 are therefore unreturnable. However, in the first exemplary embodiment, banknotes of non-pay-out denominations are stacked in the temporary holding section 3. Paid in banknotes of non-pay-out denominations can accordingly be returned since the temporary holding section 3 includes a separating function.

Figure 5:
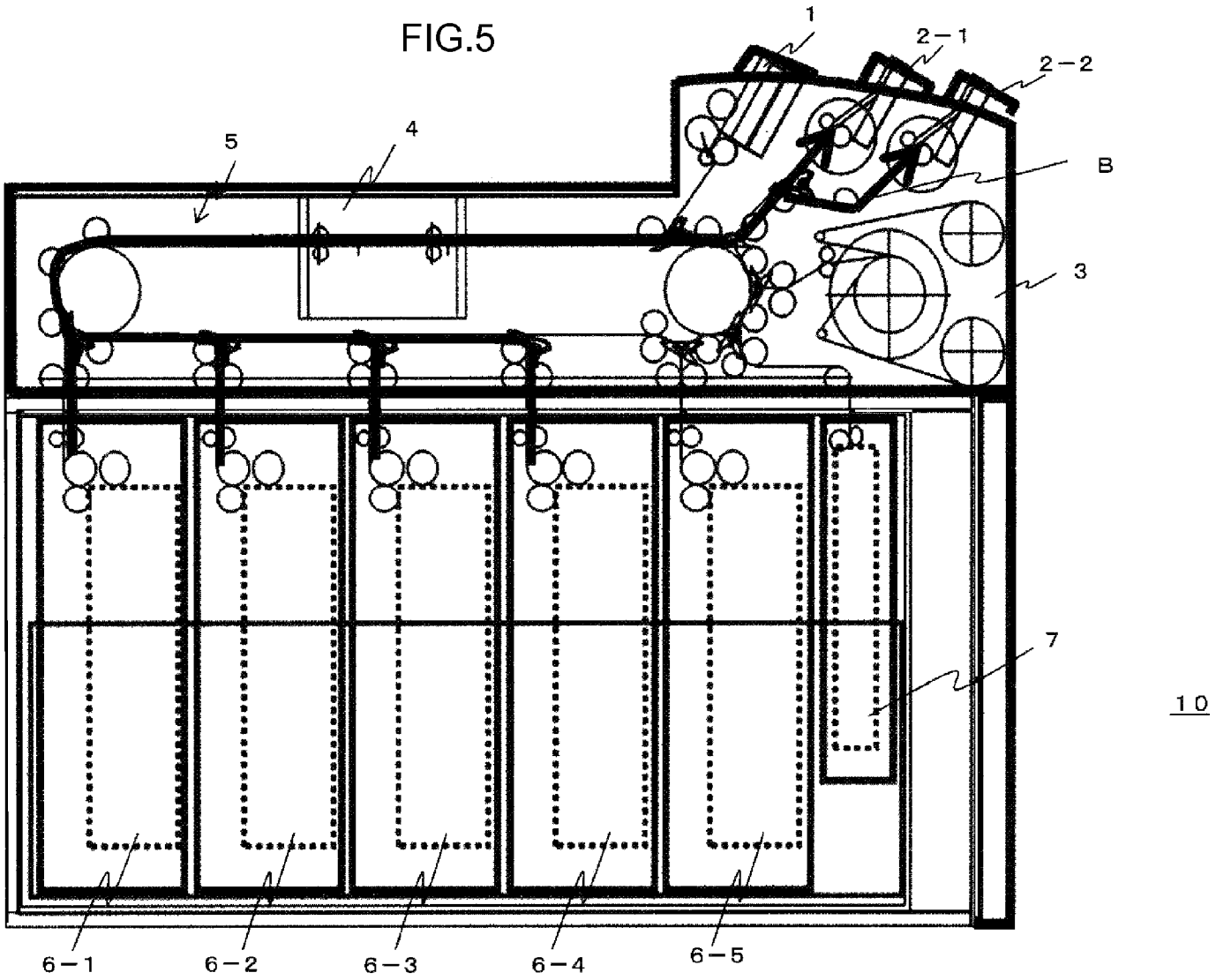
FIG. 5 is an explanatory drawing to explain banknote conveyance when returning banknotes stacked in a banknote cassette of the first exemplary embodiment.

Next, the banknotes stacked in the banknote cassettes 6-1 to 6-4 are fed out one note at a time. The banknotes are dispensed into the pay-out ports 2 via the conveyance section 5, as illustrated by arrow B in FIG. 5 (S113).

Processing ends when return processing has been completed for all the banknotes (S114).

(A-3) Advantageous Effects of First Exemplary Embodiment

As described above, in the first exemplary embodiment, when performing direct pay-in processing in the recirculating cash processing device, banknotes of pay-out denominations are conveyed to the corresponding to banknote cassettes, and banknotes of non-pay-out denominations are conveyed to the temporary holding section. This thereby enables all paid in banknotes to be returned when return of the paid in banknotes is instructed.

(B) Second Exemplary Embodiment

Next, detailed explanation follows regarding a second exemplary embodiment of a cash processing device of the present invention, with reference to the drawings.

In the first exemplary embodiment described above, non-pay-out paid in banknotes can be returned after storing the inserted banknotes and completing pay-in. However, since the pay-in transaction has not been completed, a log history relating to the paid in banknotes is not recorded. Accordingly, there are concerns of being unable to confirm the quantity of banknotes to be fed out from the banknote cassettes during return.

For example, in principle, banknotes are fed out from the banknote cassettes one note at a time, and the banknote identification section classifies banknotes one note at a time. However, depending on the state of the banknotes, sometimes plural banknotes are conveyed at the same time, and the banknote identification section 4 classifies plural banknotes in an overlapping state. The correct quantity of notes to be returned cannot be verified in such cases.

When the quantity of notes to be returned cannot be verified, return of the actual banknotes that were paid in (referred to below as return of the originals) is not possible.

In the second exemplary embodiment, the quantity of banknotes to be returned from the banknote cassettes is verified such that the original banknotes are returned.

(B-1) Configuration of Second Exemplary Embodiment

The internal mechanisms of the cash processing device of the second exemplary embodiment are the same as, or correspond to, those of the first exemplary embodiment. Accordingly, the second exemplary embodiment is also explained with reference to FIG. 1.

Figure 6:
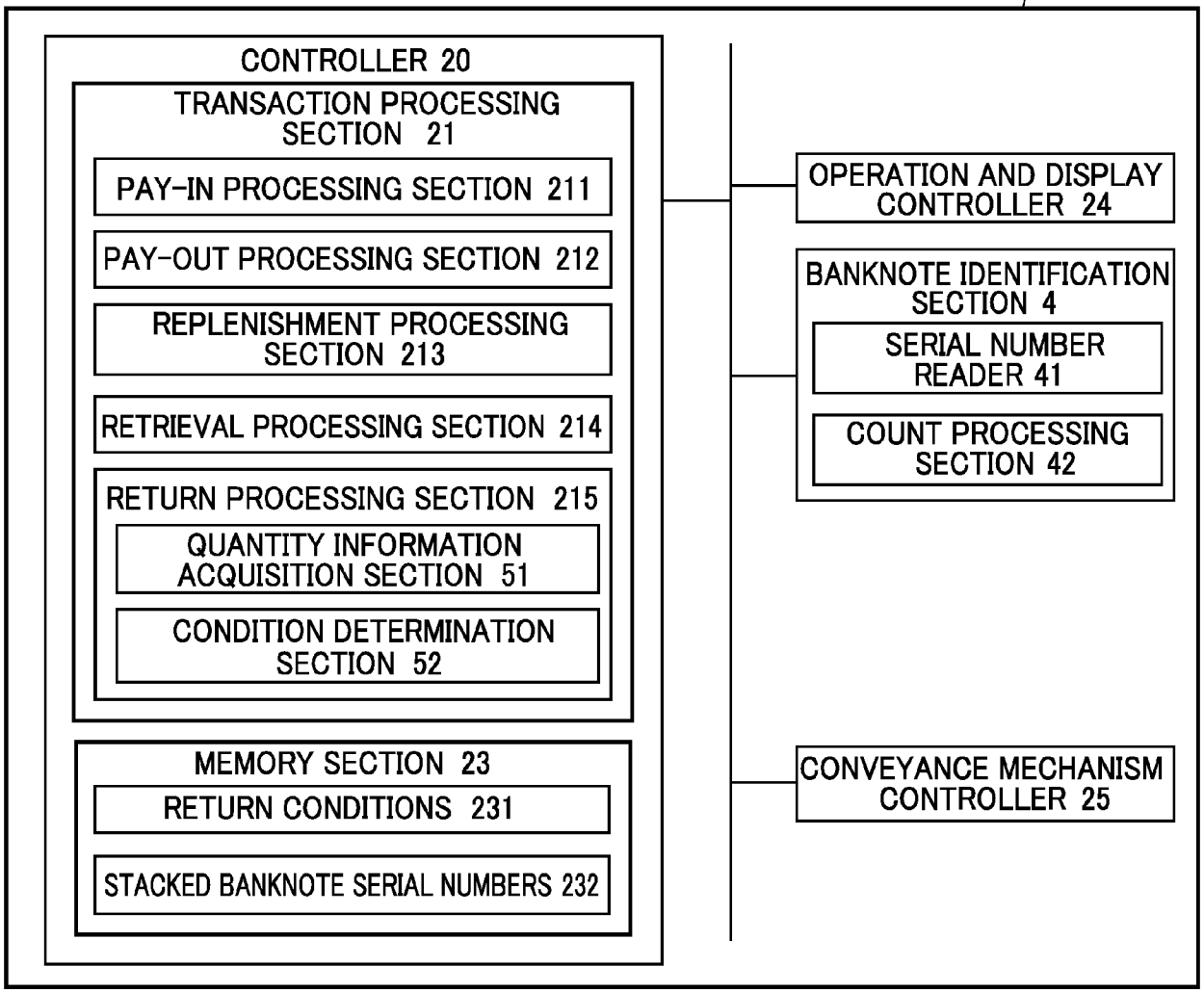
FIG. 6 is a block diagram illustrating configuration of a control system of a cash processing device of a second exemplary embodiment.

FIG. 6 is a block diagram illustrating configuration of a control system of a cash processing device 10 according to the second exemplary embodiment.

As a control system, the cash processing device 10 illustrated in FIG. 6 includes a controller 20, an operation and display controller 24, a banknote identification section 4, and a conveyance mechanism controller 25.

Similarly to in the first exemplary embodiment, the controller 20 of the second exemplary embodiment is, for example, a computer including a processor and memory (for example, a microcomputer or the like). The processor executes a processing program to implement the various functions of the cash processing device 10. The processing program may be implemented by installation. In such cases, the functionality of the processing program may still be illustrated as in FIG. 6.

As illustrated in FIG. 6, the controller 20 includes a transaction processing section 21 for controlling various transactions, and a memory section 23.

The transaction processing section 21 includes a pay-in processing section 211, a pay-out processing section 212, a replenishment processing section 213, a retrieval processing section 214, and a return processing section 215.

In the second exemplary embodiment, the return processing in which return is performed after completing pay-in in direct pay-in processing differs from in the first exemplary embodiment. The pay-in processing section 211, the pay-out processing section 212, the replenishment processing section 213, and the retrieval processing section 214 each perform processing that is the same as or corresponds to the processing of the first exemplary embodiment.

Accordingly, detailed explanation follows regarding the return processing after completing pay-in in direct pay-in processing, and detailed explanation of configuration elements that have already been described in the first exemplary embodiment is omitted.

The return processing section 215 performs similar processing to in the first exemplary embodiment. During banknote return, the return processing section 215 acquires classification results for the banknotes that have been fed out from the banknote cassettes 6-1 to 6-5 from the banknote identification section 4, and verifies the quantity of banknotes fed out from each of the banknote cassettes 6-1 to 6-5 according to predetermined conditions for confirming the quantity of notes to be returned, based on the banknote classification results and the return circumstances.

As illustrated in FIG. 6, the return processing section 215 includes a quantity information acquisition section 51, and a condition determination section 52.

The quantity information acquisition section 51 acquires from the banknote identification section 4 classification information for the banknotes fed out from the banknote cassettes 6-1 to 6-5 that have been identified by the banknote identification section 4. Specifically, the quantity information acquisition section 51 acquires information relating to the quantity of banknotes that have passed the banknote identification section 4.

Note that broadly speaking, the information relating to the quantity of banknotes from the banknote identification section 4 includes verified quantity information, and non-verified quantity information.

Verified quantity information is information relating to the quantity of banknotes when the banknote identification section 4 has accurately identified the quantity of passing banknotes. Namely, the banknote identification section 4 counts the quantity of passing banknotes. As described above, sometimes plural overlapping banknotes are conveyed together. In such cases, the banknote identification section 4 classifies the plural banknotes. A verified quantity of banknotes is a quantity of banknotes that has been correctly identified by the banknote identification section 4. For example, in cases in which a single banknote is conveyed, and the banknote identification section 4 has identified the quantity of this banknote, verified quantity information indicating that "verified quantity information is 1 note" is notified. As another example, in cases in which two banknotes are conveyed partially overlapping with each other, and the banknote identification section 4 has identified the quantity of these banknotes, verified quantity information indicating that "verified quantity information is 2" is notified.

Non-verified quantity information is information relating to the quantity of banknotes when the banknote identification section has not accurately identified the quantity of passing banknotes. For example, in cases in which plural banknotes are conveyed overlapping perfectly with each other, the banknote identification section 4 is able to identify from the difference in thickness that it is not a single banknote. However, sometimes the quantity of the banknotes cannot be correctly identified. In such cases, the banknote identification section 4 notifies non-verified quantity information indicating that "verified quantity information is 1 or more notes".

The condition determination section 52 verifies the quantity of banknotes to be fed out from each of the banknote cassettes 6-1 to 6-5 and returned according to return conditions 231 stored in the memory section 23. Note that specifics of determination processing for the return conditions of the condition determination section 52 will be described in detail under "Operation".

Similarly to in the first exemplary embodiment, the memory section 23 is stored with processing programs and information required during processing, as well as the return conditions 231 and banknote serial numbers 232.

The banknote serial numbers 232 is information relating to the serial numbers of the banknotes stacked in the respective banknote cassettes 6-1 to 6-5. The banknote serial numbers are serial numbers of the banknotes that have been read by a serial number reader 41 of the banknote identification section 4.

The return conditions 231 is information relating to conditions to be used by the return processing section 215 in return processing after completion of pay-in in direct pay-in processing.

The banknote identification section 4 performs similar processing to in the first exemplary embodiment. FIG. 6 illustrates a functional configuration of the banknote identification section 4 in order to clarify the processing functions of the banknote identification section 4 according to the second exemplary embodiment.

The banknote identification section 4 includes the serial number reader 41 and a count processing section 42.

The serial number reader 41 reads the serial numbers of passing banknotes.

The count processing section 42 counts the quantity of passing banknotes. The count processing section 42 passes the verified quantity information and the non-verified quantity information to the controller 20 as banknote quantity information.

(B-2) Operation of the Second Exemplary Embodiment

Next, detailed explanation follows regarding operation of the return processing after completion of pay-in in direct pay-in processing in the cash processing device 10 of the second exemplary embodiment, with reference to the drawings.

Figure 7A:
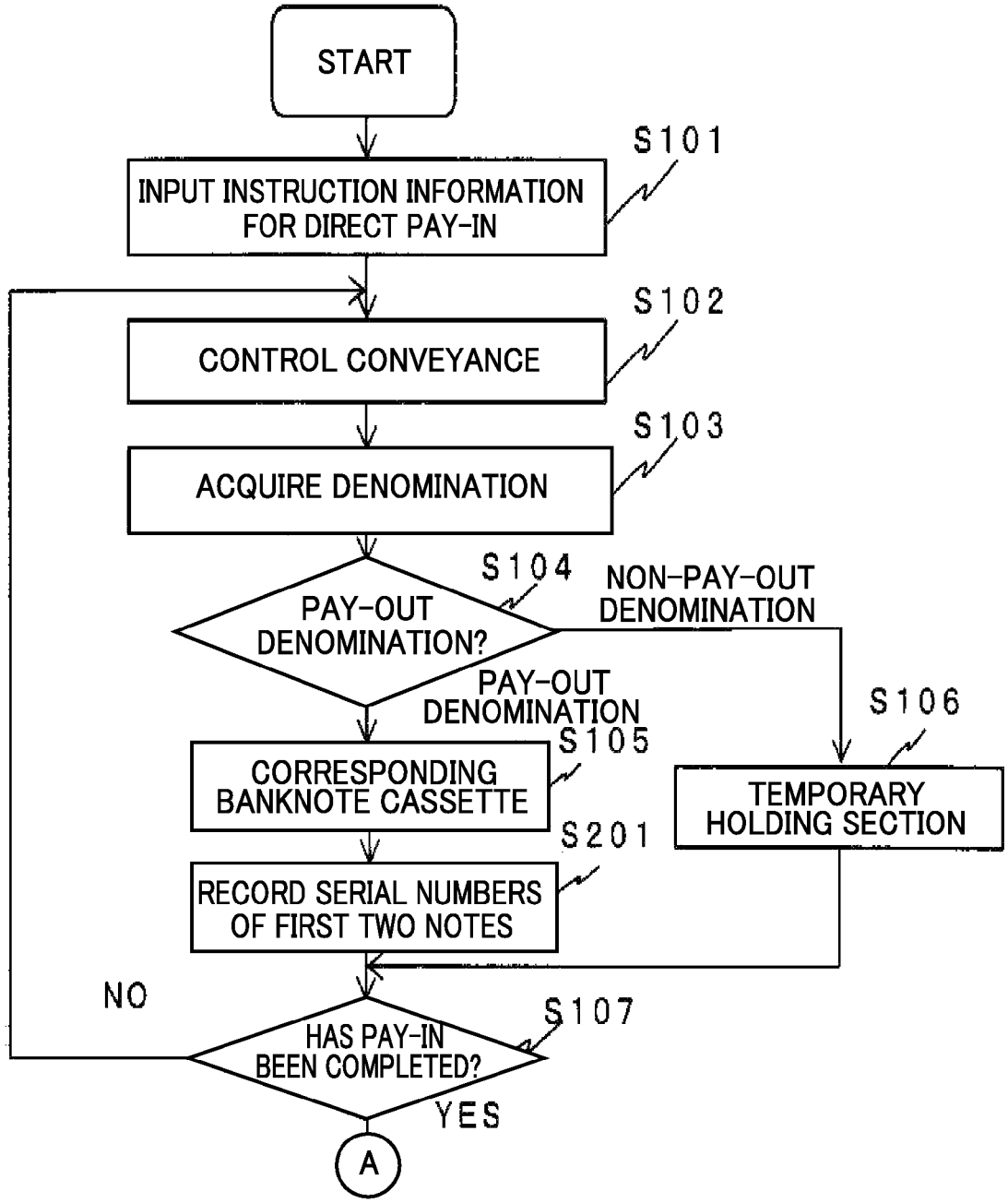
FIG. 7A is a flowchart (1) illustrating banknote conveyance processing and return processing in direct pay-in processing of a cash processing device of the second exemplary embodiment.
Figure 7B:
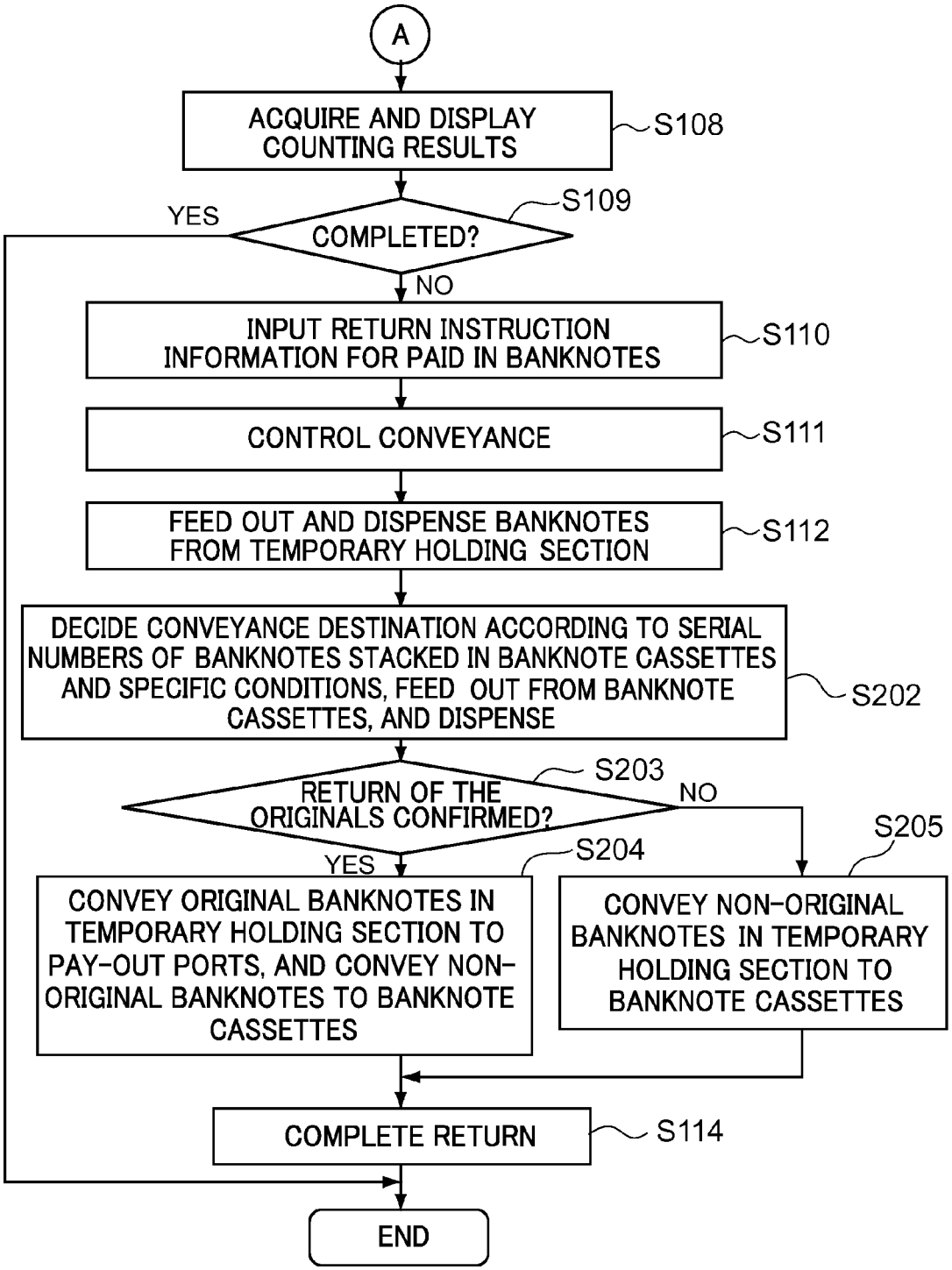
FIG. 7B is a flowchart (2) illustrating banknote conveyance processing and return processing in direct pay-in processing of a cash processing device of the second exemplary embodiment.

(B-2-1) Return Processing After Completion of Pay-In in Direct Pay-In Processing FIG. 7A and FIG. 7B are flowcharts illustrating banknote conveyance processing and return processing in direct pay-in processing in the cash processing device 10 of the second exemplary embodiment. In FIG. 7A and FIG. 7B, processing that is the same as or corresponds to that in FIG. 3A and FIG. 3B in the first exemplary embodiment is allocated the same reference numerals.

First, in the second exemplary embodiment, when storing banknotes in the banknote cassettes 6-1 to 6-5 of the cash processing device 10, the controller 20 records the serial numbers of the final two banknotes to have been stored in the banknote cassettes 6-1 to 6-5 for each of the recirculating banknote cassettes 6-1 to 6-5.

Figure 8:
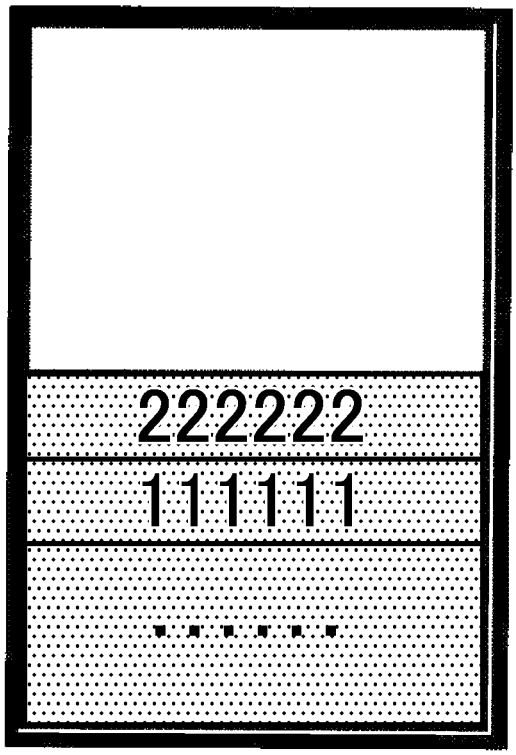
FIG. 8 is an explanatory drawing to explain banknote serial numbers recorded in a memory section of the second exemplary embodiment.

FIG. 8 is an explanatory drawing to explain the banknote serial numbers 232 recorded in the memory section 23 in the second exemplary embodiment.

As illustrated in FIG. 8, out of the respective banknotes stored in the respective banknote cassettes 6-1 to 6-5, the banknote serial numbers 232 recorded in the memory section 23 are the serial numbers of the final two banknotes to have been stored. The final two banknotes to have been stored are the two uppermost banknotes amongst the accumulated banknotes in the banknote cassettes 6-1 to 6-5. For example, in the example illustrated in FIG. 8, the serial numbers of the final two banknotes to have been stored are "serial number: 111111" and "serial number: 222222".

Referring to FIG. 7A, when performing direct pay-in processing (S101), conveyance control is performed similarly to in the first exemplary embodiment (S102). Namely, the banknotes placed in the pay-in port 1 are fed out one note at a time. The fed out banknotes reach the banknote identification section 4 via the conveyance section 5.

The banknote identification section 4 reads the denominations and the serial numbers of the banknotes (S103). The conveyance destination of each banknote is decided based on the denomination determined by the banknote identification section 4, and the banknotes are conveyed to their conveyance destinations (S104 to S106).

Namely, when the denomination of a banknote is a non-pay-out denomination, the banknote is conveyed to the temporary holding section 3 (S106).

On the other hand, when the denomination of a banknote is a pay-out denomination, the banknote is conveyed to the corresponding recirculating banknote cassette 6-1 to 6-5 (S104).

When this is performed, the controller 20 records the serial numbers of the first two banknotes to be stored in the respective banknote cassettes 6-1 to 6-5 in the memory section 23 for each of the recirculating banknote cassettes 6-1 to 6-5 (S201).

Figure 9:
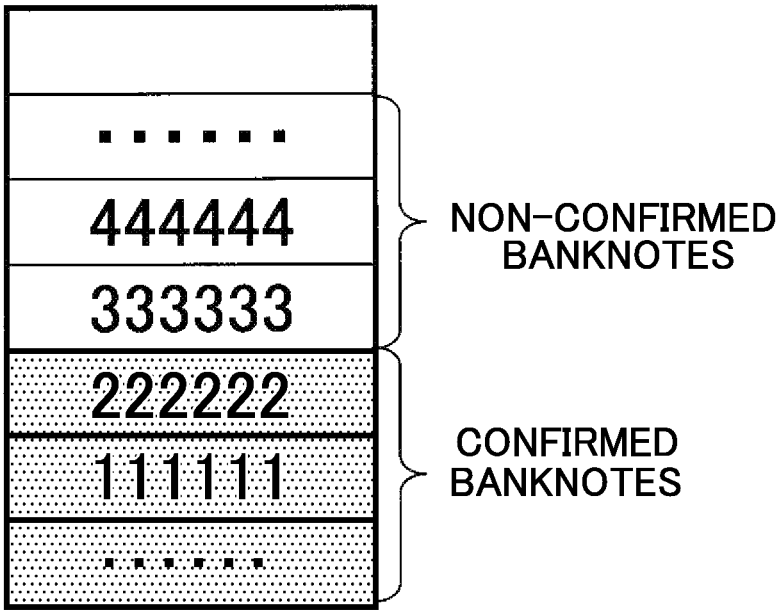
FIG. 9 is an explanatory drawing to explain serial numbers of banknotes stored in a banknote cassette, recorded in a memory section of the second exemplary embodiment.

FIG. 9 is an explanatory drawing to explain the serial numbers of the banknotes stored in the banknote cassettes 6-1 to 6-5 that are recorded in the memory section 23 in the second exemplary embodiment.

As illustrated in FIG. 9, out of the banknotes paid into the recirculating banknote cassettes 6-1 to 6-5 during direct pay-in processing, the serial numbers of the first two banknotes are recorded in the memory section 23. Namely, the directly paid in banknotes are laid on top of the last two banknotes to have been previously accumulated in the banknote cassettes 6-1 to 6-5. In the example in FIG. 9, the paid in banknote with "serial number: 333333" and the banknote with "serial number: 444444" are stored on top of the banknote with "serial number: 222222".

As illustrated in FIG. 9, the two previously accumulated banknotes whose serial numbers have been recorded are referred to as "confirmed banknotes", and the paid in banknotes whose serial numbers have been recorded are referred to as "non-confirmed banknotes".

Recording the serial numbers of the banknotes stored in each of the banknote cassettes 6-1 to 6-5 as illustrated in FIG. 8 and FIG. 9 performs the role of partitioning in order to determine whether or not return of the originals is possible. Namely, when returning banknotes, determination can be made as to whether a banknote fed out from the banknote cassettes 6-1 to 6-5 is a banknote that was paid in on the current occasion, or a banknote that was already accumulated prior to the pay-in of the current occasion.

The pay-in operation is completed once all of the banknotes placed in the pay-in port 1 have been conveyed (S107). The controller 20 performs display of the counting results or the like (S108). After completion of the pay-in operation, return (cancellation) of the paid in banknotes is executed. When instructing the return of paid in banknotes, the return instruction is, for example, accompanied by stipulation of the denomination and quantity of banknotes to be returned by operator operation.

When a direct pay-in transaction is not completed (S109), and return instruction (cancellation) information is input for the paid in banknotes (S110), the return processing section 215 conveys the banknotes accumulated in the temporary holding section 3 to the pay-out ports 2 (S111, S112).

Once return of all of the banknotes accumulated in the temporary holding section 3 has been completed, the return processing section 215 feeds out banknotes to be returned that have been conveyed to the banknote cassettes 6-1 to 6-5, and conveys the banknotes to the banknote identification section 4.

When this is performed, the return processing section 215 acquires from the banknote identification section 4 verified quantity information for the banknotes (information indicating the identified quantity of banknotes), and the serial numbers read by the banknote identification section 4.

The return processing section 215 decides the conveyance destination of each banknote fed out from the banknote cassettes 6-1 to 6-5, and conveys the banknote to the decided conveyance destination, based on the serial numbers of the final two banknotes in the respective banknote cassettes 6-1 to 6-5 recorded in the memory section 23, on the serial numbers of the first two banknotes to be stored in the respective banknote cassettes 6-1 to 6-5 during direct pay-in processing, and the return conditions 231 recorded in the memory section 23 (S202).

The return processing section 215 conveys and dispenses the banknotes paid in during direct pay-in processing (the original banknotes) in the pay-out ports 2, and banknotes for which it is unclear whether or not they are original banknotes are conveyed to the temporary holding section 3. In this manner, original banknotes and banknotes for which it is unclear whether or not they are original banknotes are temporarily separated and return of the originals is confirmed.

When the return processing section 215 has completed feeding out for the quantity of banknotes to be returned, the return processing section 215 halts the banknote conveyance operation, and determines whether or not it is possible to confirm return of the originals (S203).

In cases in which it is possible to confirm return of the originals, if banknotes are present in the temporary holding section 3, the return processing section 215 conveys banknotes not applicable to the return of the originals to the banknote cassettes 6-1 to 6-5, and conveys original banknotes to the pay-out ports 2 (S204). The return processing section 215 also notifies an application that return of the originals has been confirmed.

However, in cases in which return of the originals could not be confirmed, if banknotes still remain in the temporary holding section 3, the return processing section 215 conveys the banknotes to the banknote cassettes 6-1 to 6-5 (S205). The return processing section 215 also notifies the application that return of the originals has not been confirmed.

(B-2-2) Banknote Feed-Out Processing from Banknote Cassettes

Next, detailed explanation follows regarding the processing at S202 in FIG. 7B, with reference to the drawings.

FIG. 10A and FIG. 10B are explanatory drawings to explain the return conditions 231 in return processing of banknotes paid in directly according to the second exemplary embodiment.

The return processing section 215 conveys the banknotes fed out from the banknote cassettes 6-1 to 6-5 to either the pay-out ports 2 or the temporary holding section 3, while making determination regarding the various conditions illustrated in FIG. 10A and FIG. 10B.

To aid explanation, in FIG. 10A and FIG. 10B, the various conditions are labeled "a", "b", "c", and so on to "i" along the column direction (vertical direction) of FIG. 10A and FIG. 10B, and are labeled "1-1", "1-2", "2", and so on to "4" along the row direction (horizontal direction) of FIG. 10A and FIG. 10B.

For example, in the following explanation, operation for the condition "1-1" and the condition "a" is denoted ("1-1"-"a").

The diagonally hatched portions in FIG. 10A are cases that do not arise when the quantity of notes to be returned has been counted correctly. However, since processing operation for such cases is also set out in FIG. 10A, they will be explained below.

(B-2-2-1) "No Stack in Temporary Holding Section or Serial Number of Second Non-Confirmed Banknote has Been Detected"

First, explanation follows regarding banknote conveyance operation corresponding to various conditions for "no stack in temporary holding section or serial number of second non-confirmed banknote has been detected".

"No stack in temporary holding section or serial number of second non-confirmed banknote has been detected" is operation performed when either banknotes fed out from the banknote cassettes 6-1 to 6-5 have been accumulated in the temporary holding section 3, or the serial number of the second non-confirmed banknote to have been paid in has been detected amongst the banknotes fed out from the banknote cassettes 6-1 to 6-5.

For "no stack in temporary holding section or serial number of second non-confirmed banknote has been detected", broadly speaking, processing is performed split into cases in which "quantity of notes instructed to be returned−quantity of notes returned≥2", and for cases in which the "quantity of notes instructed to be returned−quantity of notes returned=1".

When the "quantity of notes instructed to be returned−quantity of notes returned≥2", banknotes fed out from the banknote cassettes 6-1 to 6-5 are passed to the banknote identification section 4, and quantity verification processing is performed by the banknote identification section 4.

(1) Processing ("1-1"-"a")

When the return processing section 215 receives classification results from the banknote identification section 4 and the serial number of the fed out banknote is the "second non-confirmed banknote" (for example, "serial number: 444444" in FIG. 9), the banknote is conveyed to the pay-out ports 2. When this is performed, the return processing section 215 also increments by 1 the "quantity of notes returned" that indicates the quantity of the paid in banknotes that have been returned.

(2) Processing ("1-2"-"b")

Processing transitions to ("1-2"-"b") when the "quantity of notes instructed to be returned−quantity of notes returned=1" as a result of increasing the quantity of notes returned by 1 in ("1-1"-"a"). In such cases, when the return processing section 215 receives the classification results from the banknote identification section 4 and the serial number of the fed out banknote is the "first non-confirmed banknote" (for example, "serial number: 333333" in FIG. 9), the banknote is conveyed to the pay-out ports. When this is performed, the return processing section 215 determines the "return of the originals confirmed", since return of the originals for the paid in banknotes has been completed. Moreover, when this is performed, in cases in which the banknote following behind the "first non-confirmed banknote" has already been fed out from the banknote cassettes 6-1 to 6-5 to the banknote identification section 4, this following banknote is conveyed to the temporary holding section 3. Processing then transitions to condition "4" and enters a state awaiting a halt in conveyance.

(3) Processing ("1-1"-"b")

In cases in which the "quantity of notes instructed to be returned−quantity of notes returned≥2", when the return processing section 215 receives the classification results from the banknote identification section 4 and the serial number of the fed out banknote is the "first non-confirmed banknote" (for example, "serial number: 333333" in FIG. 9), the banknote is conveyed to the pay-out ports 2. When this is performed, the return processing section 215 also increments by 1 the "quantity of notes returned" that indicates the quantity of the paid in banknotes that have been returned. When this is performed, it is conceivable that an error could have arisen when counting the quantity of original banknotes to be returned. Accordingly, the return processing section 215 transitions processing to condition "4", and enters a state awaiting a halt in conveyance.

(4) Processing ("1-1"-"c"), Processing ("1-1"-"d")

In cases in which the "quantity of notes instructed to be returned−quantity of notes returned≥2", when the return processing section 215 receives the classification results from the banknote identification section 4 and the serial number of the fed out banknote is the "first confirmed banknote" (for example, "serial number: 222222" in FIG. 9), or the "second confirmed banknote" (for example, "serial number: 111111" in FIG. 9), the banknote is conveyed to the temporary holding section 3. Again, in such cases, it is conceivable that an error could have arisen when counting the quantity of original banknotes to be returned. Accordingly, the return processing section 215 transitions processing to condition "4" and enters a state awaiting a halt in conveyance.

(5) Processing ("1-1"-"e")

In cases in which the "quantity of notes instructed to be returned–quantity of notes returned≥2", when the return processing section 215 receives the classification results from the banknote identification section 4 and the serial number of the fed out banknote is neither that of a non-confirmed banknote nor of a confirmed banknote, the banknote is conveyed to the pay-out ports 2. When this is performed the return processing section 215 increments the "quantity of notes returned" by 1.

(6) Processing ("1-1"-"f")

In principle, banknotes fed out from the banknote cassettes 6-1 to 6-5 are passed to the banknote identification section 4 one note at a time. However, sometimes plural banknotes may be passed to the banknote identification section 4 in an overlapping state. When this occurs, the banknote identification section 4 sometimes counts two banknotes at the same time. In such cases, the banknote identification section 4 notifies the controller 20 with information that "banknotes of verifiable quantity: quantity=2" as the "verified quantity information".

In cases in which the "quantity of notes instructed to be returned–quantity of notes returned≥2", the banknotes are conveyed to the pay-out ports 2 when there is notification from the banknote identification section 4 that "banknotes of verifiable quantity: quantity=2". The banknote following behind the two banknotes on the current occasion is conveyed to the temporary holding section 3. Processing then transitions to condition "4" and enters a state awaiting a halt in conveyance.

(7) Processing ("1-1"-"g")

In cases in which, for example, plural fed out banknotes are passed to the banknote identification section 4 in an overlapping state, the banknote identification section 4 is sometimes unable to identify the quantity of banknotes, and counts a quantity of at least one or more note. In such cases, the banknote identification section 4 notifies the controller 20 with "banknotes of unverifiable quantity: quantity=1 or more" as the "non-verified quantity information".

In cases in which the "quantity of notes instructed to be returned–quantity of notes returned≥2", and "banknotes of unverifiable quantity=1 or more" is notified from the banknote identification section 4, the banknotes are conveyed to the temporary holding section 3. The return processing section 215 also increments the quantity of notes returned by 1. The banknotes are stacked in the temporary holding section 3, and, since the quantity of the banknotes has been counted by the banknote identification section 4 in an overlapping state, processing transitions to the processing for condition "2".

(8) Processing ("1-1"-"h")

In cases in which, for example, plural fed out banknotes are passed to the banknote identification section 4 in an overlapping state, the banknote identification section 4 is sometimes unable to identify the quantity of banknotes, and counts a quantity of at least two or more notes. In such cases, the banknote identification section 4 notifies the controller 20 with "banknotes of unverifiable quantity: quantity=2 or more" as the "non-verified quantity information".

In cases in which the "quantity of notes instructed to be returned–quantity of notes returned≥2", and "banknotes of unverifiable quantity: quantity=2 or more" is notified from the banknote identification section 4, the banknotes are conveyed to the temporary holding section 3. The return processing section 215 also increments the quantity of notes returned by 2. In such cases, since the remaining quantity of notes to be returned may no longer be known, processing transitions to the processing for condition "3".

(9) Processing ("1-2"-"a")

In cases in which the "quantity of notes instructed to be returned–quantity of notes returned=1", when the return processing section 215 receives classification results from the banknote identification section 4 and the serial number of the fed out banknote is the "first non-confirmed banknote" (for example, "serial number: 444444" in FIG. 9), the banknote is conveyed to the temporary holding section 3. Again, in such cases, it is conceivable that an error could have arisen when counting the quantity of original banknotes to be returned. Accordingly, the return processing section 215 transitions processing to condition "4", and enters a state awaiting a halt in conveyance.

(10) Processing ("1-2"-"c"), Processing ("1-2"-"d")

In cases in which the "quantity of notes instructed to be returned–quantity of notes returned=1", when the return processing section 215 receives classification results from the banknote identification section 4 and the serial number of the fed out banknote is the "first confirmed banknote" (for example, "serial number: 222222" in FIG. 9) or the "second confirmed banknote" (for example, "serial number: 111111" in FIG. 9), similar processing is performed to the processing ("1-1"-"c") or processing ("1-1"-"c"). Namely, the banknote is conveyed to the temporary holding section 3. Again, in such cases, it is conceivable that an error could have arisen when counting the quantity of original banknotes to be returned. Accordingly, the return processing section 215 transitions processing to condition "4", and enters a state awaiting a halt in conveyance.

(11) Processing ("1-2"-"e")

In cases in which the "quantity of notes instructed to be returned–quantity of notes returned=1", when the return processing section 215 receives classification results from the banknote identification section 4 and the serial number of the fed out banknote is neither that of a non-confirmed banknote nor of a confirmed banknote, the banknote is conveyed to the pay-out ports 2. When this is performed, the return processing section 215 increments the "quantity of notes returned" by 1. Since this is a case in which the remaining quantity of banknotes to be returned is "1", the return processing section 215 confirms the return of the originals at this point.

In principle, the banknote identification section 4 reads the serial numbers. However, depending on the state of the banknote, sometimes the serial number cannot be read correctly. Accordingly, the return of the originals is confirmed when "quantity of notes instructed to be returned–quantity of notes returned=1", even in cases in which, for example, the serial number read by the banknote identification section 4 is not the serial number of a non-confirmed banknote. Note that the banknote following behind is conveyed to the temporary holding section 3, and processing transitions to condition "4", and enters a state awaiting a halt in conveyance.

(12) Processing ("1-2"-"f")

In cases in which the "quantity of notes instructed to be returned–quantity of notes returned=1", and "banknotes of verifiable quantity: quantity=2" is notified from the banknote identification section 4, these two banknotes are conveyed to the temporary holding section 3.

Since this is a case in which "quantity of notes instructed to be returned–quantity of notes returned=1", a single banknote should be returned. However, in cases such as this, two banknotes are fed out overlapping with each other. In such cases, the return processing section 215 determines that return of the originals is not possible, and the two banknotes are conveyed to the temporary holding section 3 instead of dispensing the two banknotes in the pay-out ports 2. Then, conveyance to the pay-out ports 2 is performed based on reclassification by the banknote identification section 4. Processing then transitions to condition "4", and enters a state awaiting a halt in conveyance.

(13) Processing ("1-2"-"g")

In cases in which the "quantity of notes instructed to be returned−quantity of notes returned=1", and "banknotes of unverifiable quantity: quantity=1 or more" is notified from the banknote identification section 4, the banknote(s) are conveyed to the temporary holding section 3. The return processing section 215 also increments the quantity of notes returned by 1. In such cases, since the remaining quantity of notes to be returned may be no longer known, processing transitions to the processing for condition "3".

(14) Processing ("1-2"-"h")

In cases in which the "quantity of notes instructed to be returned−quantity of notes returned=1", and "banknotes of unverifiable quantity: quantity=2 or more" is notified from the banknote identification section 4, the banknotes are conveyed to the temporary holding section 3. In such cases, the return processing section 215 determines that return of the originals is not possible, and conveys the at least two or more banknotes to the temporary holding section 3. In such cases, processing transitions to the processing of condition "4", and enters a state awaiting a halt in conveyance.

(B-2-2-1) "Stack Present in Temporary Holding Section and Serial Number of Second Non-Confirmed Banknote Not Yet Detected"

Next, explanation follows regarding banknote conveyance operation corresponding to various conditions for "stack present in temporary holding section and serial number of second non-confirmed banknote not yet detected".

"Stack present in temporary holding section and serial number of second non-confirmed banknote not yet detected" is operation when banknotes fed out from the banknote cassettes 6-1 to 6-5 have been accumulated in the temporary holding section 3, and the serial number of the second non-confirmed banknote to have been paid in has not been detected amongst the banknotes fed out from the banknote cassettes 6-1 to 6-5.

(15) Processing ("2"-"a")

For "stack present in temporary holding section and serial number of second non-confirmed banknote not yet detected", when the return processing section 215 receives the classification results from the banknote identification section 4 and the serial number of the fed out banknote is the "second non-confirmed banknote", the banknote is conveyed to the pay-out ports 2.

In such cases, a state exists in which at least one or more banknotes of unverifiable quantity are accumulated in the temporary holding section 3. Accordingly, the return processing section 215 sets the value of the "quantity of notes instructed to be returned−1" to the "quantity of notes returned", thereby enabling the quantity of notes returned to be correctly rectified.

Processing then transitions to conditions "1" (namely "1-1", "1-2").

(16) Processing ("2"-"b")

For "stack present in temporary holding section and serial number of second non-confirmed banknote not yet detected", when the return processing section 215 receives the classification results from the banknote identification section 4 and the serial number of the fed out banknote is the "first non-confirmed banknote", similar processing to the processing ("1-2"-"a") is performed.

Namely, the banknote is conveyed to the pay-out ports 2. When this is performed, the return processing section 215 determines the "return of the originals confirmed", since the return of the originals has been completed for the paid in banknotes. The banknote following behind is conveyed to the temporary holding section 3. Processing then transitions to condition "4", and enters a state awaiting a halt in conveyance.

(17) Processing ("2"-"c")

For "stack present in temporary holding section and serial number of second non-confirmed banknote not yet detected", when the return processing section 215 receives the classification results from the banknote identification section 4 and the serial number of the fed out banknote is the "first confirmed banknote" ("serial number: 222222" in FIG. 9), the banknote is conveyed to the temporary holding section 3.

In such cases, the confirmed banknote is conveyed to the temporary holding section 3 since the original banknotes have already been returned. The return processing section 215 confirms the return of the originals, transitions processing to condition "4", and enters a state awaiting a halt in conveyance. The banknote following behind is conveyed to the temporary holding section 3.

(18) Processing ("2"-"d")

For "stack present in temporary holding section and serial number of second non-confirmed banknote not yet detected", when the return processing section 215 receives the classification results from the banknote identification section 4 and the serial number of the fed out banknote is the "second confirmed banknote" ("serial number: 111111" in FIG. 9) the banknote is conveyed to the temporary holding section 3.

In such cases, since the banknote is the second confirmed banknote, the return processing section 215 determines that return of the originals is not possible (original cannot be guaranteed), transitions processing to condition "4", and enters a state awaiting a halt in conveyance.

(19) Processing ("2"-"e")

For "stack present in temporary holding section and serial number of second non-confirmed banknote not yet detected", when the return processing section 215 receives the classification results from the banknote identification section 4 and the serial number of the fed out banknote is neither that of a non-confirmed banknote nor of a confirmed banknote, the banknote is conveyed to the pay-out ports 2. The return processing section 215 also increments the quantity of notes returned by 1.

(20) Processing ("2"-"f")

For "stack present in temporary holding section and serial number of second non-confirmed banknote not yet detected", when "banknotes of verifiable quantity: quantity=2" is notified from the banknote identification section 4, the return processing section 215 increments the quantity of notes returned by 2, and compares the quantity of notes returned against the quantity of notes instructed to be returned.

When "quantity of notes returned≤quantity of notes instructed to be returned", the banknotes are conveyed to the pay-out ports 2. Namely, since this is a case in which "quantity of notes returned≤quantity of notes instructed to be returned", the fed out banknotes are determined to be original banknotes, and are conveyed to the pay-out ports 2.

On the other hand, in cases in which the "quantity of notes returned>quantity of notes instructed to be returned", the banknotes are conveyed to the temporary holding section 3. Namely, since the quantity of notes returned exceeds the quantity of notes instructed to be returned, they may not be original banknotes, and these notes are conveyed to the temporary holding section 3.

(21) Processing ("2"-"g")

For "stack present in temporary holding section and serial number of second non-confirmed banknote not yet detected", when "banknotes of unverifiable quantity: quantity=1 or more" is notified from the banknote identification section 4, the return processing section 215 increments the quantity of notes returned by 1, and conveys the banknote(s) to the temporary holding section.

(22) Processing ("2"-"h")

For "stack present in temporary holding section and serial number of second non-confirmed banknote not yet detected", when "banknotes of unverifiable quantity: quantity=2 or more" is notified from the banknote identification section 4, the return processing section 215 increments the quantity of notes returned by 2, and conveys the banknotes to the temporary holding section.

(22) Processing ("2"-"i")

For "stack present in temporary holding section and serial number of second non-confirmed banknote not yet detected", after the processing ("2"-"a") to ("2"-"h"), the return processing section 215 compares the quantity of notes returned against the quantity of notes instructed to be returned, and performs the following processing regardless of the nature of the verified note quantity.

The return processing section 215 transitions processing to condition "3" when, based on the quantity information from the banknote identification section 4, the "quantity of notes returned=quantity of notes instructed to be returned".

The return processing section 215 transitions processing to condition "4" when, based on the quantity information from the banknote identification section 4, the "quantity of notes returned>quantity of notes instructed to be returned".

(B-2-2-3) "Awaiting Confirmed Banknote"

"Awaiting confirmed banknote" is processing performed when the quantity of notes that should be returned is no longer known, until the serial number of a confirmed banknote in the banknote cassettes 6-1 to 6-5 is detected by the banknote identification section 4.

In such cases, a quantity of extra banknotes of a predetermined quantity of notes (for example 2 notes) added to the quantity of notes instructed to be returned are fed out from the banknote cassettes 6-1 to 6-5, and based on the serial numbers of the extra fed out banknotes, determination is made as to whether or not return of the originals has been confirmed.

(24) Processing ("3"-"a"), Processing ("3"-"b")

For "awaiting confirmed banknote", when the return processing section 215 receives classification results from the banknote identification section 4 and the serial number of the fed out banknote is that of a non-confirmed banknote, the banknote is conveyed to the temporary holding section 3. In such cases, processing transitions to condition "4", and enters a state awaiting a halt in conveyance.

(25) Processing ("3"-"c")

For "awaiting confirmed banknote", when the return processing section 215 receives classification results from the banknote identification section 4 and the serial number of the fed out banknote is that of the "first confirmed banknote" ("serial number: 222222" in FIG. 9), similar processing is formed to in the processing ("2"-"a").

Namely, the banknote is conveyed to the temporary holding section 3. In such cases, the confirmed banknote is conveyed to the temporary holding section 3 since the original banknotes have already been returned. Further, the return processing section 215 also confirms the return of the originals, transitions processing to condition "4", and enters a state awaiting a halt in conveyance. The banknote following behind is also conveyed to the temporary holding section 3.

(26) Processing ("3"-"d")

For "awaiting confirmed banknote", when the return processing section 215 receives classification results from the banknote identification section 4 and the serial number of the fed out banknote is that of the "second confirmed banknote" ("serial number: 111111" in FIG. 9), the banknote is conveyed to the temporary holding section 3. Further, the banknote following behind is also conveyed to the temporary holding section 3.

In such cases, the return processing section 215 determines that return of the originals has been confirmed when quantity information from the banknote identification section 4 for the banknote fed out immediately prior to the banknote of the current occasion (the second confirmed banknote) corresponds to "banknotes of verifiable quantity: quantity=1", and the immediately preceding banknote has been conveyed to the temporary holding section. Processing then transitions to condition "4", and enters a state awaiting a halt in conveyance.

In cases other than the above, the return processing section 215 determines that return of the originals is not possible (original cannot be guaranteed), transitions processing to condition "4", and enters a state awaiting a halt in conveyance.

(27) Processing ("3"-"e") to Processing ("3"-"h")

For "awaiting confirmed banknote", when the return processing section 215 receives classification results from the banknote identification section 4 and the serial number of the fed out banknote is neither that of a non-confirmed banknote nor of a confirmed banknote, or when "banknotes of verifiable quantity=2" is received from the banknote identification section 4, or when "banknotes of unverifiable quantity: quantity=or more", or when "banknotes of unverifiable quantity: quantity=2 or more", the banknote(s) are conveyed to the temporary holding section 3.

(28) Processing ("3"-"i")

When "awaiting confirmed banknote", after the processing ("3"-"a") to the processing ("3"-"h"), the return processing section 215 compares the quantity of notes returned against the quantity of notes instructed to be returned, and performs the following processing, regardless of the nature of the verified note quantity.

The return processing section 215 halts the separating function to feed out banknotes from the banknote cassettes 6-1 to 6-5, and, when no medium (banknote) is present on the conveyance section 5, the return processing section 215 determines that return of the originals is not possible (original cannot be guaranteed), and halts conveyance.

(B-2-2-4) "State Awaiting Halt in Conveyance"

The "state awaiting halt in conveyance" is operation in which, when halting feeding out banknotes from the banknote cassettes 6-1 to 6-5 and halting conveyance, the conveyance operation is halted once conveyance of banknotes remaining in the conveyance section 5 has been completed for any banknotes present in the conveyance section 5.

(29) Processing ("4"-"a") to Processing ("4"-"h")

In the "state awaiting halt in conveyance", any banknotes present in the conveyance section 5 are conveyed to the temporary holding section 3.

(30) Processing ("4"-"i")

When "awaiting halt in conveyance", after the processing ("4"-"a") to the processing ("4"-"h"), the return processing section 215 compares the quantity of notes returned against the quantity of notes instructed to be returned, and performs the following processing regardless of the nature of the verified note quantity.

The return processing section 215 halts the separating function to feed out banknotes from the banknote cassettes 6-1 to 6-5, and the return processing section 215 halts conveyance when no medium (banknote) is present on the conveyance section 5.

The return processing section 215 conveys banknotes to the temporary holding section 3 when it has been determined that return of the originals has been confirmed.

(B-3) Advantageous Effects of Second Exemplary Embodiment

As described above, in the second exemplary embodiment, in addition to the advantageous effects of the first exemplary embodiment, the serial numbers of the banknotes conveyed to the banknote cassettes are recorded and used in determination during return. An improvement in return rates for original banknotes may accordingly be expected in comparison to the first exemplary embodiment.

(C) Third Exemplary Embodiment

Next, detailed explanation follows regarding a third exemplary embodiment of a cash processing device of the present invention, with reference to the drawings.

If denominations other than those conveyed to the recirculating type banknote cassettes are conveyed to the storage-only cassette in direct pay-in processing, return of the originals is not possible, but storage processing to confirm the pay-in transaction takes little time.

However, in the first and second exemplary embodiments, when denominations other than those conveyed to the recirculating type banknote cassettes are conveyed to the temporary holding section in order to perform return of the original banknotes, the storage processing takes time due to the operation to convey banknotes in the temporary holding section to the banknote cassettes during storage processing to confirm the pay-in transaction.

Accordingly, in the third exemplary embodiment, pay-in transaction processing can be set flexibly in the cash processing device 10.

(C-1) Configuration and Operation of Third Exemplary Embodiment

The internal mechanisms of the cash processing device of the third exemplary embodiment are the same as, or correspond to, those of the first and second exemplary embodiments. Accordingly, the third exemplary embodiment is also explained with reference to FIG. 1.

Figure 11:
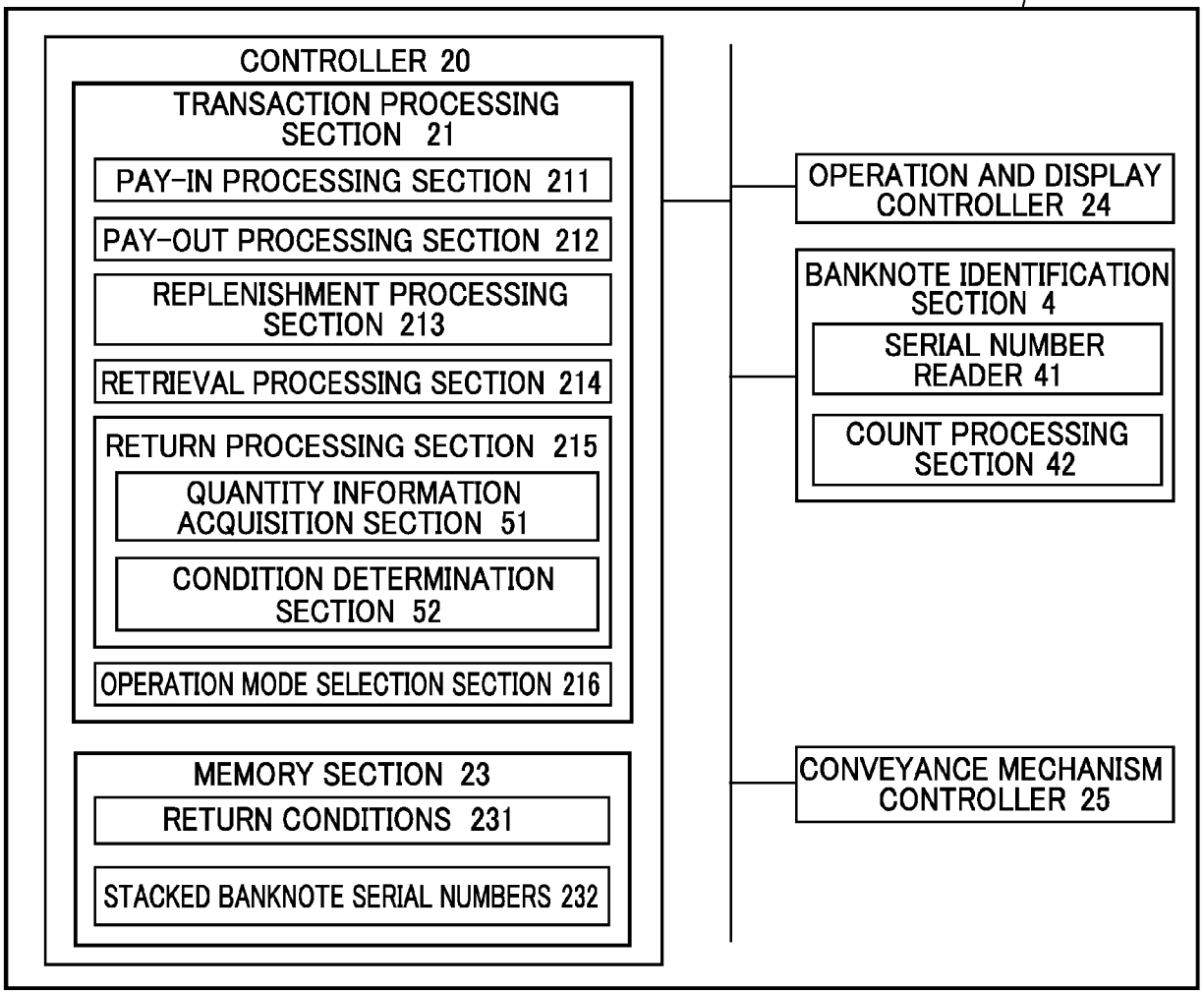
FIG. 11 is an internal configuration diagram illustrating internal mechanisms of a cash processing device according to a third exemplary embodiment.

FIG. 11 is a block diagram illustrating configuration of a control system of a cash processing device 10 according to the third exemplary embodiment.

As a control system, the cash processing device 10 illustrated in FIG. 11 includes a controller 20, an operation and display controller 24, a banknote identification section 4, and a conveyance mechanism controller 25.

In the cash processing device 10 of the third exemplary embodiment, the controller 20 includes an operation mode selection section 216 that, through operator operation, acquires selection information of an pay-in transaction operation mode.

In addition to normal pay-in processing and the direct pay-in processing described in the first and second exemplary embodiments, the pay-in processing section 211 of the controller 20 also performs conventional direct pay-in processing.

Note that the direct pay-in processing explained in the first and second exemplary embodiments is referred to as "return of the originals priority processing", and the conventional direct pay-in processing is referred to as "processing time priority processing".

In "processing time priority processing", return of the originals may not be possible depending on the denominations paid in. However, since conveyance to the temporary holding section 3 is not performed, it is processing in which storage takes little time.

Specifically, in banknote conveyance in "processing time priority processing", the banknotes inserted into the pay-in port 1 are passed to the banknote identification section 4. The banknote identification section 4 determines whether or not the denomination of each banknote is a pay-out denomination. Pay-out denomination banknotes are conveyed to the corresponding banknote cassettes 6-1 to 6-5. On the other hand, non-pay-out banknotes are conveyed to the storage-only cassette 7 that does not include a separating function.

Operation mode selection by the operation mode selection section 216 is instructed by the operator, for example using the operation and display section. Either the "return of the originals priority processing" or the "processing time priority processing" operation mode may be chosen.

Specifically, prior to starting a direct pay-in transaction operation, the operation mode selection section 216 displays a selection screen for the "return of the originals priority processing" and "processing time priority processing" operation modes.

The operation mode selection section 216 then records the direct pay-in operation mode instructed by the operator in a mode storage region (memory section 23) in the cash processing device 10.

When the direct pay-in transaction operation starts, the pay-in processing section 211 acquires the operation mode recorded in the mode storage region, and performs direct pay-in operation according to the operation mode.

(C-3) Advantageous Effects of the Third Exemplary Embodiment

As described above, in the third exemplary embodiment, enabling setting of the direct pay-in operation mode allows the operator to select the best processing for the circumstances (whether to prioritize processing time or to prioritize return of the originals).

(D) Other Exemplary Embodiments

Various modified exemplary embodiments of the present invention have been described in the first, second, and third exemplary embodiments described above. However, the present invention may be widely applied, as in the following modified exemplary embodiments.

(D-1)

In the first, second, and third exemplary embodiments described above, explanation has been given regarding cases in which the present invention is applied to a cash processing device installed at a service counter in a financial institution, for example. However, the cash processing device of the present invention may be widely applied, as long as it is a cash processing device that recirculates and recycles banknotes. For example, application may be made to recirculating Automated Teller Machines (ATMs), or to cash processing devices configuring part of an accounting system configured by plural devices.

(D-2)

In the second exemplary embodiment described above, explanation has been given regarding a case in which the serial numbers of the most recent two banknotes are recorded as the serial numbers of the banknotes previously stored in the respective banknote cassettes. However, there is no limitation to the serial numbers of the most recent two banknotes, and three or more notes may be employed. Similarly, three or more notes may be employed for the serial numbers of the first two banknotes to have been paid in on the current occasion of direct pay-in.

(D-3)

In the first, second, and third exemplary embodiments described above, explanation has been given regarding the storage-only cassette that only includes a stacking function. However, setting may be made such that a storage-only cassette including both a stacking function and a separating function is employed as the storage-only cassette.

The disclosure of Japanese Patent Application No. 2013-113279 is incorporated in its entirety by reference herein. All cited documents, patent applications and technical standards mentioned in the present specification are incorporated by reference in the present specification to the same extent as if the individual cited document, patent application, or technical standard was specifically and individually indicated to be incorporated by reference.

The invention claimed is:

1. A cash processing device, comprising:

a pay-in section that takes in an inserted medium during a pay-in transaction;

a pay-out section that dispenses a dispensed medium;

a medium identification section that classifies the inserted medium as one of at least a first type medium and a second type medium, the first type medium being for pay-out, the second type medium being not for pay-out, a conveyance section that conveys the first and second type mediums;

an operation section that receives a first instruction input for completing the pay-in transaction and a second instruction input for returning the inserted medium;

a first medium storage section that stores the first type medium;

a second medium storage section that stores the second type medium;

a temporary holding section that temporarily stores the second type medium; and a pay-in processing section that, based on a classification result by the medium identification section, controls the conveyance section to convey the first type medium taken by the pay-in section to the first medium storage section and to convey the second type medium taken by the pay-in section to the temporary holding section, and upon the operation section receiving the first instruction input, controls the conveyance section to convey the second type medium stored in the temporary holding section to the second medium storage section; and a return processing section that, upon the operation section receiving the second instruction input, controls the conveyance section to convey the second type medium stored in the temporary holding section to the pay-out section and to convey the first type medium stored in the first medium storage section, paid in during a current pay-in transaction, to the pay-out section.

2. The cash processing device of claim 1, wherein the pay-in processing section includes a first operation mode in which, the pay-in processing section controls the conveyance section to convey the first type medium taken by the pay-in section to the first medium storage section and to convey the second type medium taken by the pay-in section to the temporary holding section, and a second operation mode in which, the pay-in processing section controls the conveyance section to convey the first type medium taken by the pay-in section to the first medium storage section and to convey the second type medium taken by the pay-in section to the second medium storage section; and further comprising a setting switching section that switches settings between the first operation mode and the second operation mode.

3. The cash processing device of claim 1, further comprising:

a medium information storage section that records first medium identification information of the most recent medium that have already been stored in the first medium storage section, and second medium identification information of the inserted medium that was taken by the pay-in section during the current pay-in transaction; and wherein the return processing section controls the conveyance section to convey the first type medium stored in first medium storage section to the medium identification section, and controls the conveyance section to convey the medium paid in during the current pay-in transaction that was stored in the first medium storage section to the pay-out section based on a classification result of the medium by the medium identification section, and on the first medium identification information and the second medium identification information.

4. The cash processing device of claim 3, wherein:

based on the classification result of the medium by the medium identification section, and on the first medium identification information and the second medium identification information, the return processing section controls the conveyance section to convey a medium verifiable as the medium paid in during the current pay-in transaction to the pay-out section, and controls the conveyance section to convey a medium not verifiable as the medium paid in during the current pay-in transaction to the temporary holding section.

5. The cash processing device of claim 4, wherein the return processing section controls the conveyance section to convey a medium not verifiable as the medium paid in during the current pay-in transaction stored in the temporary holding section to the medium identification section again, and controls the conveyance section to convey the medium paid in during the current pay-in transaction to the pay-out section.

6. The cash processing device of claim 3, wherein:

the return processing section follows predetermined return conditions to discriminate between a medium verifiable as a medium paid in during the current pay-in transaction and a medium not verifiable as a medium paid in during the current pay-in transaction, based on the classification result of the medium by the medium identification section, and on the first medium identification information and the second medium identification information.

7. The cash processing device of claim 6, wherein:

the return processing section follows the predetermined return conditions to confirm the quantity of notes of the medium fed out from the first medium storage section based on a quantity of notes that should be returned from the first medium storage section, and information on the quantity of notes of the medium identified by the medium identification section.

* * * * *